US006895199B2

(12) United States Patent
Sato et al.

(10) Patent No.: US 6,895,199 B2
(45) Date of Patent: May 17, 2005

(54) PROCESS CARTRIDGE INCLUDING A PROTRUDING MEMBER ENGAGING A REGULATING GUIDE OF AN ELECTROPHOTOGRAPHIC IMAGE FORMING APPARATUS TO WHICH THE PROCESS CARTRIDGE IS ATTACHABLE AND FROM WHICH THE CARTRIDGE IS DETACHABLE AND SUCH AN ELECTROPHOTOGRAPHIC IMAGE FORMING APPARATUS

(75) Inventors: Minoru Sato, Shizuoka (JP); Kiyoshi Amano, Tokyo (JP); Shinya Noda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/097,016

(22) Filed: Mar. 14, 2002

(65) Prior Publication Data

US 2002/0131790 A1 Sep. 19, 2002

(30) Foreign Application Priority Data

Mar. 16, 2001 (JP) ..... 2001-075941

(51) Int. Cl.[7] ..... G03G 15/00
(52) U.S. Cl. ..... 399/111
(58) Field of Search ..... 399/111, 110, 399/109

(56) References Cited

U.S. PATENT DOCUMENTS

| | | | | |
|---|---|---|---|---|
| 5,331,372 | A | 7/1994 | Tsuda et al. | 355/200 |
| 5,331,373 | A | 7/1994 | Nomura et al. | 355/200 |
| 5,404,198 | A | 4/1995 | Noda et al. | 355/200 |
| 5,452,056 | A | 9/1995 | Nomura et al. | 355/200 |
| 5,463,446 | A | 10/1995 | Watanabe et al. | 355/200 |
| 5,470,635 | A | 11/1995 | Shirai et al. | 428/131 |
| 5,475,470 | A | 12/1995 | Sasago et al. | 355/210 |
| 5,488,459 | A | 1/1996 | Tsuda et al. | 355/211 |
| 5,510,878 | A | 4/1996 | Noda et al. | 355/211 |
| 5,528,341 | A | 6/1996 | Shishido et al. | 355/200 |
| 5,583,613 | A | 12/1996 | Kobayashi et al. | 355/200 |
| 5,585,889 | A | 12/1996 | Shishido et al. | 355/200 |
| 5,602,623 | A | 2/1997 | Nishibata et al. | 399/111 |
| 5,608,509 | A | 3/1997 | Shirai et al. | 399/351 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |
| 5,749,027 | A | 5/1998 | Ikemoto et al. | 399/113 |
| 5,774,766 | A | 6/1998 | Karakama et al. | 399/111 |
| 5,828,928 | A | 10/1998 | Sasago et al. | 399/111 |
| 5,870,654 | A | 2/1999 | Sato et al. | 399/109 |
| 5,878,310 | A | 3/1999 | Noda et al. | 399/117 |
| 5,890,036 | A | 3/1999 | Karakama et al. | 399/119 |
| 5,899,602 | A | 5/1999 | Noda et al. | 399/111 |
| 5,911,096 | A | 6/1999 | Batori et al. | 399/111 |
| 5,920,752 | A | 7/1999 | Karakama et al. | 399/111 |
| 5,930,562 | A | 7/1999 | Noda et al. | 399/114 |
| 5,940,658 | A | 8/1999 | Yokoi et al. | 399/119 |
| 5,943,528 | A | 8/1999 | Akutsu et al. | 399/110 |

(Continued)

*Primary Examiner*—Quana Grainger
(74) *Attorney, Agent, or Firm*—Fitzpatrick, Cella, Harper & Scinto

(57) ABSTRACT

Conventionally, an electrophotographic image forming apparatus by means of an electrophotographic image forming process has a process cartridge which integrates the electrophotographic photosensitive body and process means into a cartridge which can be detachably mounted on the image forming apparatus. In order to obtain a fine image in that kind of image forming apparatus, it is necessary that the process cartridge is mounted accurately at a predetermined position in the image forming apparatus and interface portions of various electrical contacts and driving transmission part are accurately connected. For improvement, process cartridges having well mountability are provided.

26 Claims, 28 Drawing Sheets

U.S. PATENT DOCUMENTS

| | | | | |
|---|---|---|---|---|
| 5,966,566 | A | 10/1999 | Odagawa et al. | 399/109 |
| 5,974,288 | A | 10/1999 | Sato | 399/119 |
| 6,075,957 | A | 6/2000 | Batori et al. | 399/114 |
| 6,115,565 | A | 9/2000 | Noda | 399/102 |
| 6,131,007 | A | 10/2000 | Yamaguchi et al. | 399/256 |
| 6,185,390 | B1 | 2/2001 | Higeta et al. | 399/90 |
| 6,188,856 | B1 | 2/2001 | Sato | 399/119 |
| 6,201,935 | B1 | 3/2001 | Terada et al. | 399/13 |
| 6,208,818 | B1 | 3/2001 | Noda | 399/111 |
| 6,229,974 | B1 | 5/2001 | Noda | 399/111 |
| 2002/0110385 | A1 * | 8/2002 | Terada | 399/111 |

* cited by examiner

PROCESS CARTRIDGE INCLUDING A PROTRUDING MEMBER ENGAGING A REGULATING GUIDE OF AN ELECTROPHOTOGRAPHIC IMAGE FORMING APPARATUS TO WHICH THE PROCESS CARTRIDGE IS ATTACHABLE AND FROM WHICH THE CARTRIDGE IS DETACHABLE AND SUCH AN ELECTROPHOTOGRAPHIC IMAGE FORMING APPARATUS

BACKGROUND OF THE INVENTION

1. Field of the Invention

The present invention relates to a process cartridge and an electrophotographic image forming apparatus which can detachably mount the process cartridge.

Here, what is meant by the electrophotographic image forming apparatus is an apparatus to form an image on a recording medium by using an electrophotographic image forming apparatus. The examples of the electrophotographic image forming apparatus include, for example, electrophotographic copiers, electrophotographic printers (for example, laser printers, LED printers and the like), facsimile devices, word processors and multiple devices (multi-function printers and the like).

What is meant by the process cartridge is a process cartridge to integrate charging means, developing means or cleaning means as process means with an electrophotographic photosensitive body into a cartridge and make this cartridge attachable and detachable to and from an image forming apparatus main body or a process cartridge to integrate at least one of charging means, developing means or cleaning means as process means with an electrophotographic photosensitive body into a cartridge and make it attachable and detachable to and from an image forming apparatus main body or an process cartridge to integrate developing means as process means with an electrophotographic photosensitive body into a cartridge and make it attachable and detachable to and from an image forming apparatus main body.

2. Description of Related Art

Heretofore in the past, the electrophotographic image forming apparatus using an electrophotographic image forming process has adopted a process cartridge system, which integrates the electrophotographic photosensitive body and process means for operating on the electrophotographic sensitive body into a cartridge and allows for attachment and detachment of the process cartridge to and from the image forming apparatus main body. According to this process cartridge system, maintenance of the device can be performed not by the serviceman but by the user himself and, therefore, it is possible to enhance the operability remarkably. Hence, this process cartridge system has been widely used in the image forming apparatus.

In order to obtain a good (fine) image in the electrophotographic image forming apparatus using such a process cartridge, it is necessary that the process cartridge is mounted accurately at a predetermined position inside the electrophotographic image forming apparatus main body and interface portions of various electrical contacts and driving transmission parts are accurately connected.

In FIG. 24 is shown a process cartridge PC, and FIG. 25 shows a guide groove GL provided in the image forming apparatus main body PR. In FIG. 26 is shown the image forming apparatus adopting such a process cartridge PC.

With respect to attachment and detachment of the process cartridge PC to and from the image forming apparatus main body PR, as shown in FIGS. 24 to 26, a positioning boss CB is provided on a shaft line of the photosensitive body drum which is the electrophotographic photosensitive body of the process cartridge PC and a guide groove GL which guides the positioning boss CB and positions it is provided on the image forming apparatus main body PR. When the user inserts the process cartridge PC up to a predetermined position along a mounting guide GL as a cartridge mounting guide, a butting portion P provided in the image forming apparatus main body PR abuts against the process cartridge PC and is whirl-stopped with the positioning boss CB as a center. The product having such a constitution has been put to practical use.

As shown in FIG. 26, the process cartridge PC is attached with a drum shutter DS, which covers the surface of the photosensitive body drum when taken out of the image forming apparatus main body PR and exposes the surface of the photosensitive body drum when mounted on the image forming apparatus main body PR. Opening and closing of the drum shutter DS is performed by linking with the inserting operation and pulling operation performed by the user of the process cartridge PC for the image forming apparatus main body PR.

Further, there have been conceived and put to practical use those cartridges, which are provided with a spring to energize the opening/closing cover C of the image forming apparatus main body PR to a mounting direction.

Or as shown in FIG. 26, there have been available also those cartridges in which a back cover UC which imitates the outer shape of the process cartridge PC is fixed to the inside of the opening/closing cover C and, by closing the opening/closing cover C, the process cartridge PC is pushed into a normal position.

SUMMARY OF THE INVENTION

An object of the present invention is to provide a process cartridge and an electrophotographic image forming apparatus, which has improved mounting efficiency (mountability) for an electrophotographic image forming apparatus main body.

Another object of the present invention is to provide a process cartridge and an electrophotographic image forming apparatus, which can stabilize the posture of the process cartridge when the process cartridge is taken out from the electrophotographic image forming apparatus main body and placed out of the apparatus main body.

Still another object of the present invention is to provide a process cartridge and an electrophotographic image forming apparatus, which can prevent damage to the electrophotographic photosensitive body and the like when the process cartridge is taken out from the electrophotographic image forming apparatus main body and placed out of the apparatus main body.

Still another object of the present invention is to provide a process cartridge and an electrophotographic image forming apparatus, which can stabilize the posture of the process cartridge and, at the same time, can prevent damage to the electrophotographic photosensitive body when the process cartridge is taken out from the electrophotographic image forming apparatus main body and placed out of the apparatus main body.

Still another object of the present invention is to provide a process cartridge and an electrophotographic image forming apparatus, which can stabilize the posture of the process cartridge when the process cartridge is taken out from the electrophotographic image forming apparatus main body and placed out of the apparatus main body and, at the same time, comprises a function to regulate the direction to intersect the mounting direction at the time when the protruding portion provided on the frame body to prevent the damage of the electrophotographic photosensitive body mounts the process cartridge on the electrophotographic image forming apparatus main body.

Still another object of the present invention is to provide a process cartridge and an electrophotographic image forming apparatus, the process cartridge being allowed to be attached to and detached from the electrophotographic image forming apparatus main body, having:

an electrophotographic photosensitive body;

process means for operating on the electrophotographic photosensitive body;

a shutter for protecting the electrophotographic sensitive body, the shutter being movable between a protective position where the electrophotographic photosensitive body is protected and a refuge position where the electrophotographic photosensitive body takes refuge from the protective position;

a first protruding member protruding downward to the frame body in the mounting direction to mount the process cartridge on the apparatus main body;

a second protruding member protruding downward to the frame body in the mounting direction, the second protruding member engaging with a regulating guide provided in the apparatus main body at the time when the process cartridge is mounted on the apparatus main body to regulate the movement of the process cartridge to a crossing direction to cross the mounting direction; and the lowest portion of the first protruding member and the lowest portion of the second protruding member being positioned further downward than the shutter positioned at the protective position.

DETAILED DESCRIPTION OF THE PREFERRED EMBODIMENTS

Hereinafter, a process cartridge and an electrophotographic image forming apparatus according to the present invention will be described.

In the following description, what is meant by the longitudinal direction of a process cartridge is a direction to cross the direction (generally orthogonal direction) in which the process cartridge is attached or detached and is parallel to the surface of a recording medium and, at the same time, is a direction to cross (generally orthogonal to) a conveying direction of the recording medium. Further, what is meant by the right and the left is the right or the left with regard to the conveying direction of the recording medium from the upper side of the recording medium. Further, what is meant by the upper surface of the process cartridge is a surface positioned upward in a state of the process cartridge being mounted on the apparatus main body and what is meant by the bottom surface is a surface positioned downward.

Figure 1:
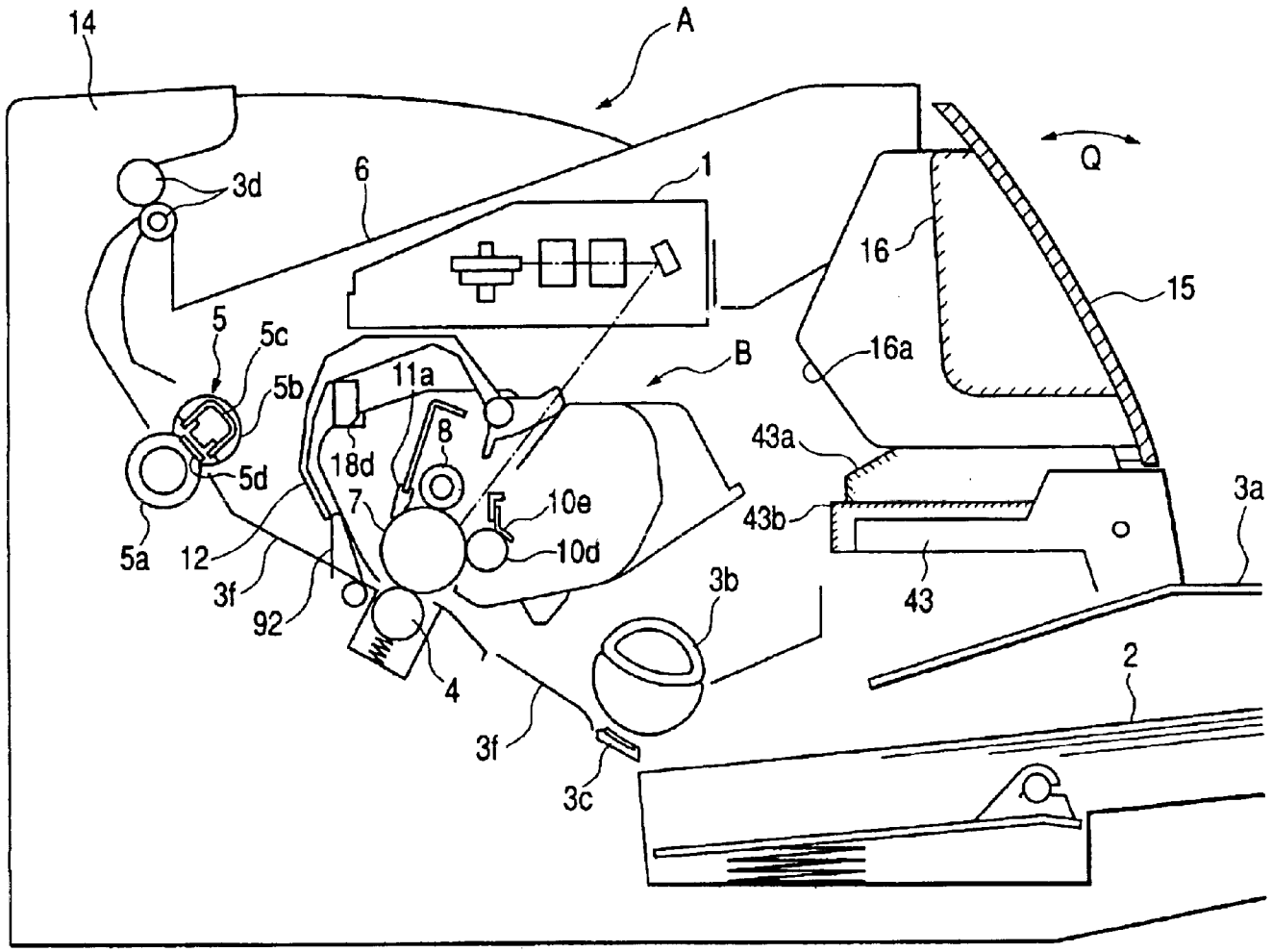
FIG. 1 is a sectional view showing a schematic constitution of one embodiment of an electrophotographic forming apparatus according to the present invention.
Figure 2:
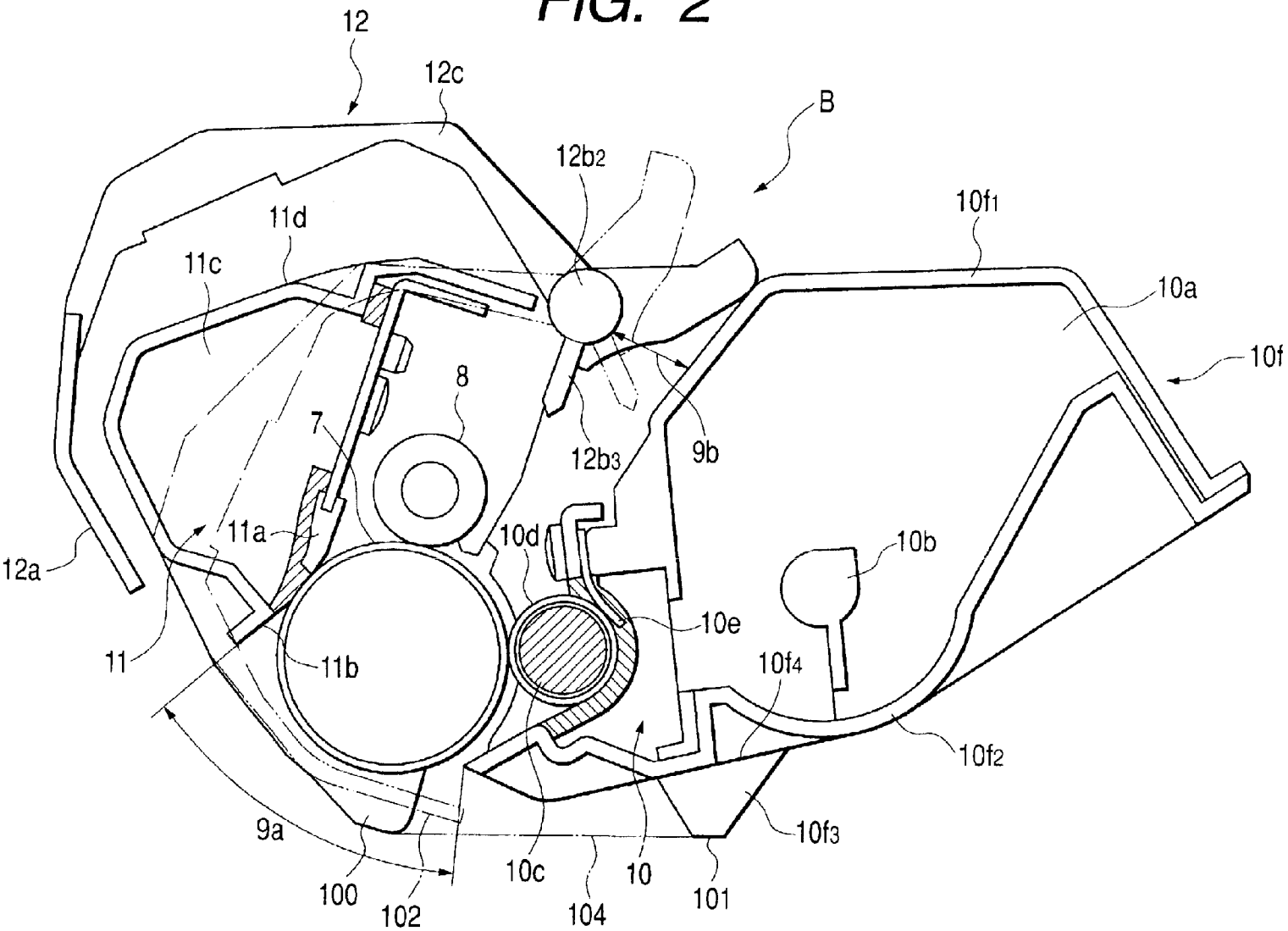
FIG. 2 is a sectional view showing the schematic constitution of one embodiment of a process cartridge according to the present invention.

FIG. 1 shows one embodiment of the electrophotographic image forming apparatus, which embodied the present invention. In the present embodiment, the process cartridge shown in FIG. 2 is attachable to and detachable from the electrophotographic image forming apparatus. Note that FIG. 1 is a block type explanatory view of the electrophotographic image forming apparatus mounted with the process cartridge and FIG. 2 is a block type explanatory view of the process cartridge.

Here, as a sequence of description, first, the entire constitution of the process cartridge and the electrophotographic image forming apparatus using the cartridge will be described and, then, the constitution of the process cartridge attachment/detachment mechanism to attach and detach the process cartridge to the electrophotographic image forming apparatus will be described.

(Entire Constitution)

In the present embodiment, an electrophotographic image forming apparatus A (hereinafter, referred to as (image forming apparatus)) that is a laser beam printer, as shown in FIG. 1, has a drum shaped electrophotographic photosensitive body 7 (hereinafter, referred to as (photosensitive drum)) as an image bearing body. The photosensitive drum 7 is uniformly charged by a charging roller 8 as charging means and, then, being irradiated by information light based on image information from an optical system 1 as optical means, an electrostatic latent image is formed on the photosensitive drum 7. This electrostatic latent image is developed by a developer (hereinafter, referred to as (toner)) and a visualized image, that is, a toner image is formed.

Synchronized with the formation of the toner image, the recording medium 2 (recording paper, OHP sheet, cloth and the like) is separately fed one sheet by one sheet from a cassette 3*a* by a pick up roller 3*b* and a pressing member 3*c* which presses against the roller and is conveyed to a transfer position. At the transfer position, the recording medium 2 is transferred with a toner image formed on the photosensitive drum 7 by applying voltage on the transfer roller 4 as transferring means. The recording medium on which the toner image was transferred is conveyed to fixing means 5 by a conveying guide 3*f*.

In the present embodiment, the fixing means 5 has a driving roller 5*a* and a fixing body of rotation 5*d*. The fixing body of rotation 5*d* has a built-in heater 5*b* and, at the same time, is constituted by a cylindrical sheet rotatably supported by a support 5*c*. This fixing body of rotation 5*d* applies heat and pressure on the passing recording medium 2 so as to fix a transfer toner image. The recording medium 2 on which the toner imager was fixed is conveyed by a discharge roller 3*d* and discharged to a discharge portion 6 through a reverse conveying path.

Note that, in the present embodiment, the pick-up roller 3*d*, the pressing member 3*c*, the discharge roller 3*d* and the like constitute conveying means.

The image forming apparatus main body A is provided with the conveying means, fixing means 5 and driving means to drive a process cartridge B. The driving means drives each body of rotation by a row of gears (not shown) by a driving force from a motor (not shown) as a driving source.

The driving force transmitted to the process cartridge B is transmitted to a large gear 83 (see FIG. 6) via the above described row of gears (not shown), and is transmitted to the process cartridge B by this large gear 83.

Figure 6:
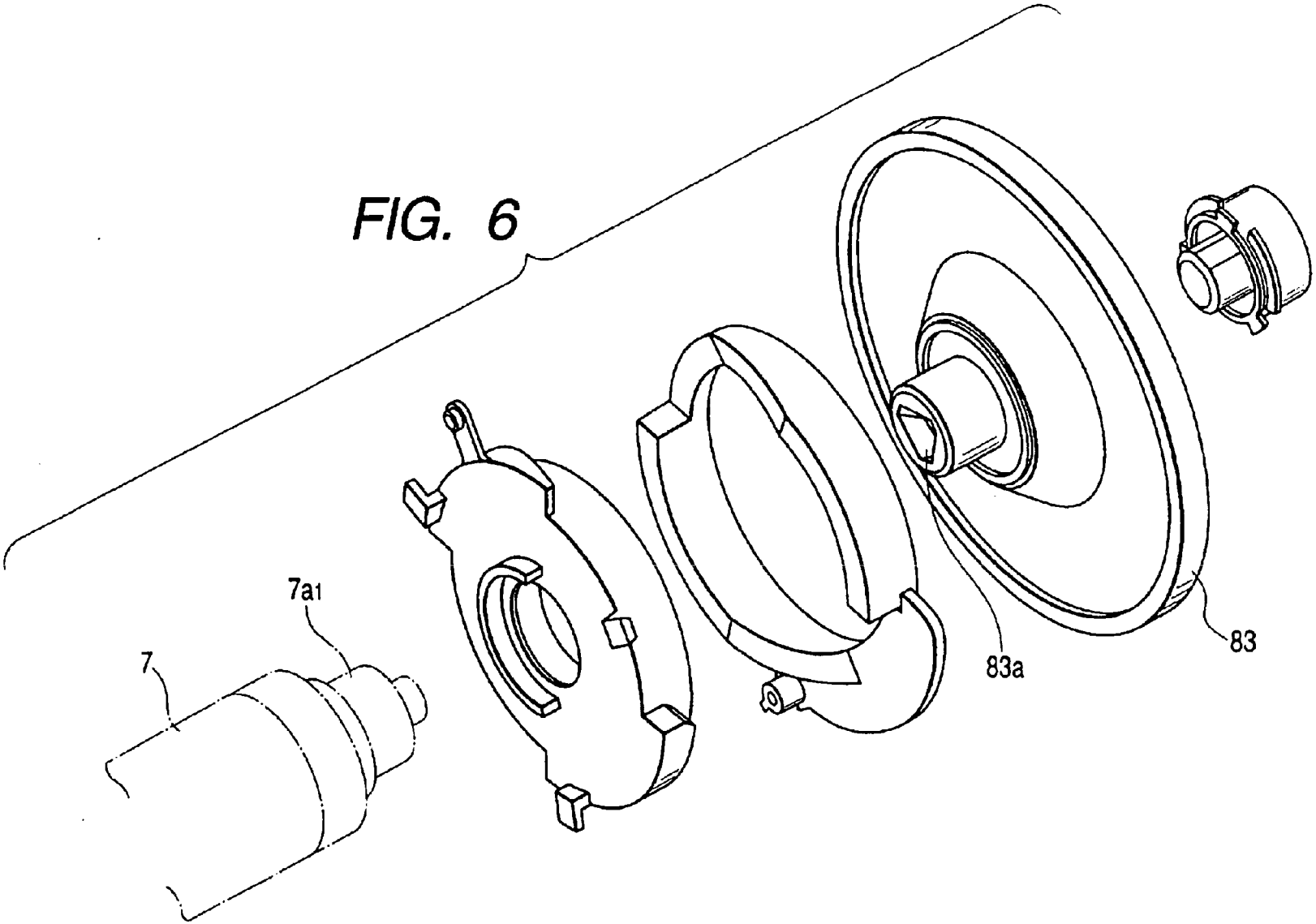
FIG. 6 is an exploded perspective view of a large gear including a coupling cam and a bearing.

That is, to be described more in detail later, as shown in FIG. 6, coupling means is constituted by a large gear coupling 83*a* which has a nearly triangle distorted hole in section formed coaxially with a rotation axis of the large gear 83 and a driving force receiving portion 7*a*1 formed by a nearly triangle distorted convex portion in section (hereinafter, referred to as a drum coupling 7*a*1). The drum coupling 7*a*1 is formed coaxially with the rotation axis of the photosensitive drum 7 on a gear flange (not shown) fixed to one end portion of the photosensitive drum 7. That is, the coupling means is coupled or released by moving the large gear coupling 83*a* in a longitudinal direction of the photosensitive drum 7.

By joining this coupling, transmission of the driving force, and aligning and positioning of the large gear 83 and the photosensitive drum 7 are performed. Accordingly, in the present embodiment, driving coupling means is provided to couple and release this coupling means.

(Process Cartridge)

The process cartridge B comprises the electrophotographic photosensitive body and at least one process means. With respect to this process means, for example, there are available charging means for charging the electrophotographic photosensitive body, developing means for developing electrostatic latent images formed on the electrophotographic photosensitive body, cleaning means for cleaning the toners remained on the electrophotographic photosensitive body and the like.

The process cartridge B of the present embodiment, as shown in FIG. 2, rotatably comprises the photosensitive drum 7 which is the electrophotographic photosensitive body having a photosensitive layer. The surface of the photosensitive drum 7 is uniformly charged by applying voltage on the charging roller 8 which is the charging means, and information light (optical image) based on image information from an optical system 1 is exposed through an exposure opening on this charged photosensitive drum 7. By so doing, electrostatic latent images are formed on the surface of the photosensitive drum 7 and the electrostatic latent images are developed by developing means 10.

The developing means 10 delivers the toners in the toner housing portion 10*a* to a developing roller 10*d* which is a developing member by a rotatable delivery member 10*b* which is toner delivery means. By rotating the developing roller 10*d*, which is built-in with a fixed magnet 10*c*, to regulate a layer thickness by a developing blade 10*e*, a toner layer imparted with frictional electrification charge is formed on the surface of the developing roller 10*d*. The toners on the surface of the developing roller 10*d* are transferred to the photosensitive drum 7 according to the electrostatic latent image, thereby a visualized image, that is, a toner imager is formed on the photosensitive drum 7.

By applying a voltage having a polarity reverse to the toner image to the transfer roller 4, the toner image is transferred on the recording medium 2. After that, by a cleaning blade 11*a* of cleaning means 11, the toners remained on the photosensitive drum 7 are scratched off and, at the same time, are scooped up by a scooping sheet 11*b*. The removed toners are collected in a removed toner housing portion 11*c*.

The process cartridge B shown in the present embodiment rotatably supports the photosensitive drum 7, and has cleaning means 11, a cleaning frame body 11 built-in with the charging roller 8 and a toner developing frame body 10*f* assembled with developing means and a toner housing portion 10*a*.

The toner developing frame body 10*f* is rotatably supported against the cleaning frame body 11*d* so that the developing roller 10*d* of the developing means 10 can oppose and be parallel to the photosensitive drum 7 at a predetermined spacing. Spacers (not shown) to maintain a space between the developing roller 10*d* and the photosensitive drum 7 are provided on both ends of the developing roller 10*d*.

Figure 3:
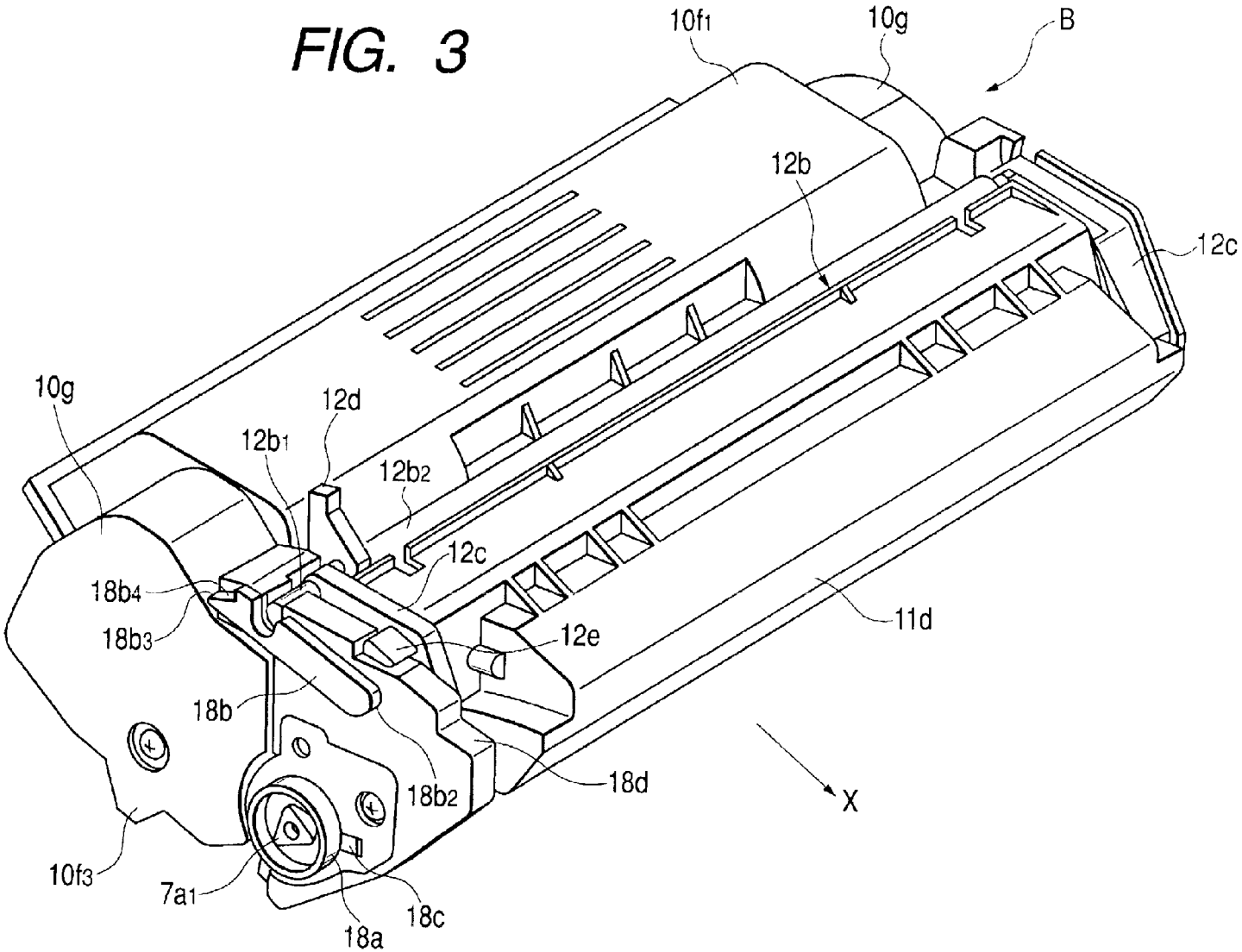
FIG. 3 is a perspective view of one embodiment of the process cartridge according to the present invention.

As shown in FIG. 3, holder members 10*g* are provided on both side surfaces of the toner developing frame body 10*f* and, though not shown, have a hanging arm formed with a joining hole to rotatably hang a developing unit on a cleaning unit. A predetermined applied pressure is given between the developing unit and the cleaning unit to maintain a space.

The process cartridge B is made as a cartridge by being housed into a cartridge frame body CF which is constituted by combining a toner developing frame body 10*f*, which was welded and integrated with a developing frame body 10*f*1 and a cover member 10*f*2, and the cleaning frame body 11*d*.

Figure 4:
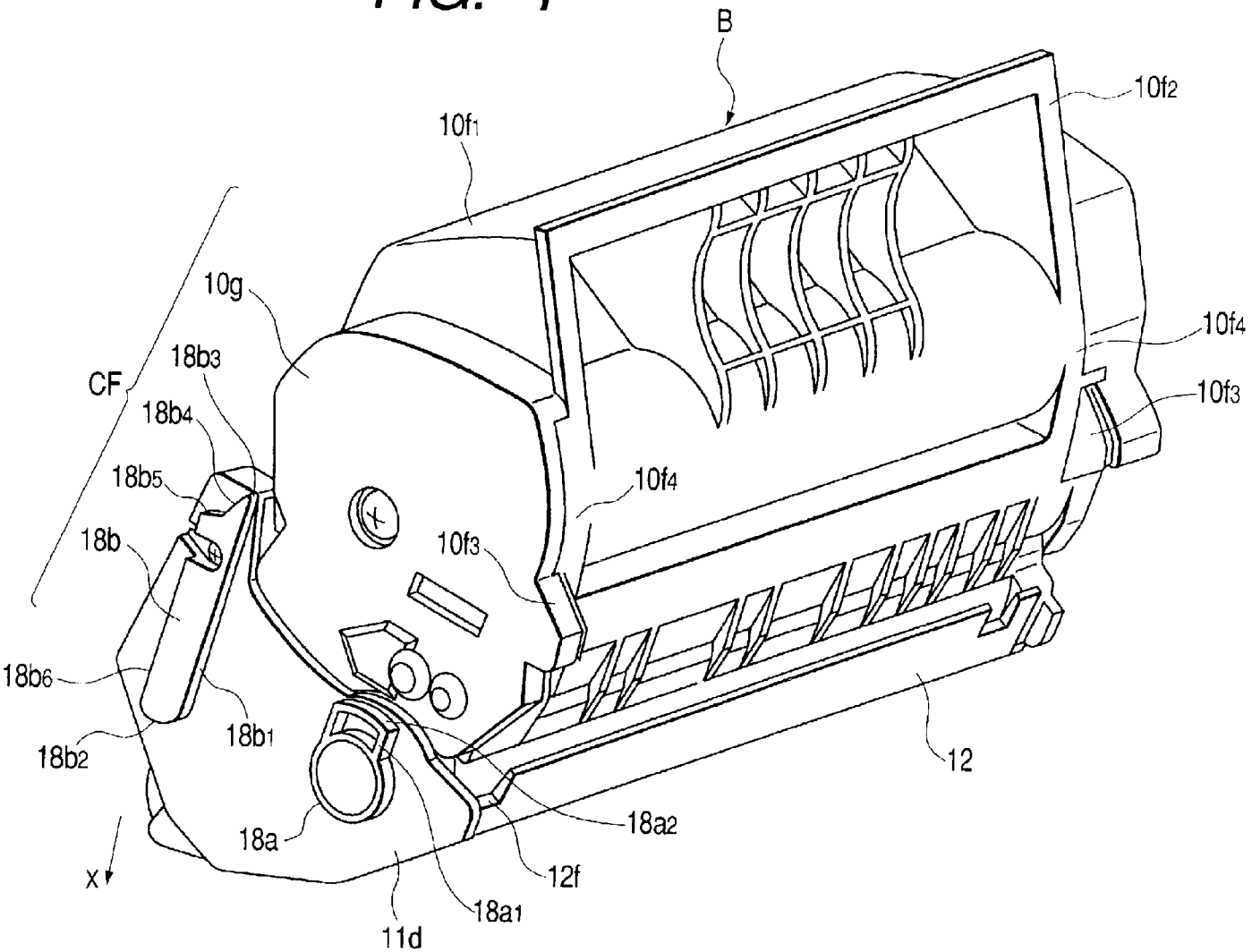
FIG. 4 is a perspective view of one embodiment of the process cartridge according to the present invention.

On both side surfaces in the longitudinal direction of the cartridge frame body CF, as shown in FIGS. 3 and 4, the first cartridge guide 18*b* to be mounted attachably and detachably in the direction of an arrow mark X to the electrophotography image forming apparatus main body (hereinafter, referred to as (image forming apparatus main body)) and the second cartridge 18*b* (hereinafter, referred to as mounting guide), the first cartridge positioning portion 18*b* which is on the same axis line as the rotation axis of the photosensitive drum 7 and is supported by positioning means (the first main body positioning portion and the second main body positioning portion) inside the image forming apparatus and the second cartridge positioning portion 18*a* (hereinafter, referred to as positioning guide 18*a*) are provided.

The positioning guide 18*a* has a cylindrical boss having a larger diameter on the driving side. An auxiliary mounting guide 18*a*1 which extends backward to the mounting direction of the process cartridge is formed on the positioning guide 18*a* of a reverse driving side as shown in FIG. 4. The rear end of this auxiliary mounting guide 18*a*1 is taken as an energized portion outer peripheral surface 18*a*2, which is a circular arc coaxial with the positioning guide 18*a*.

Figure 16:
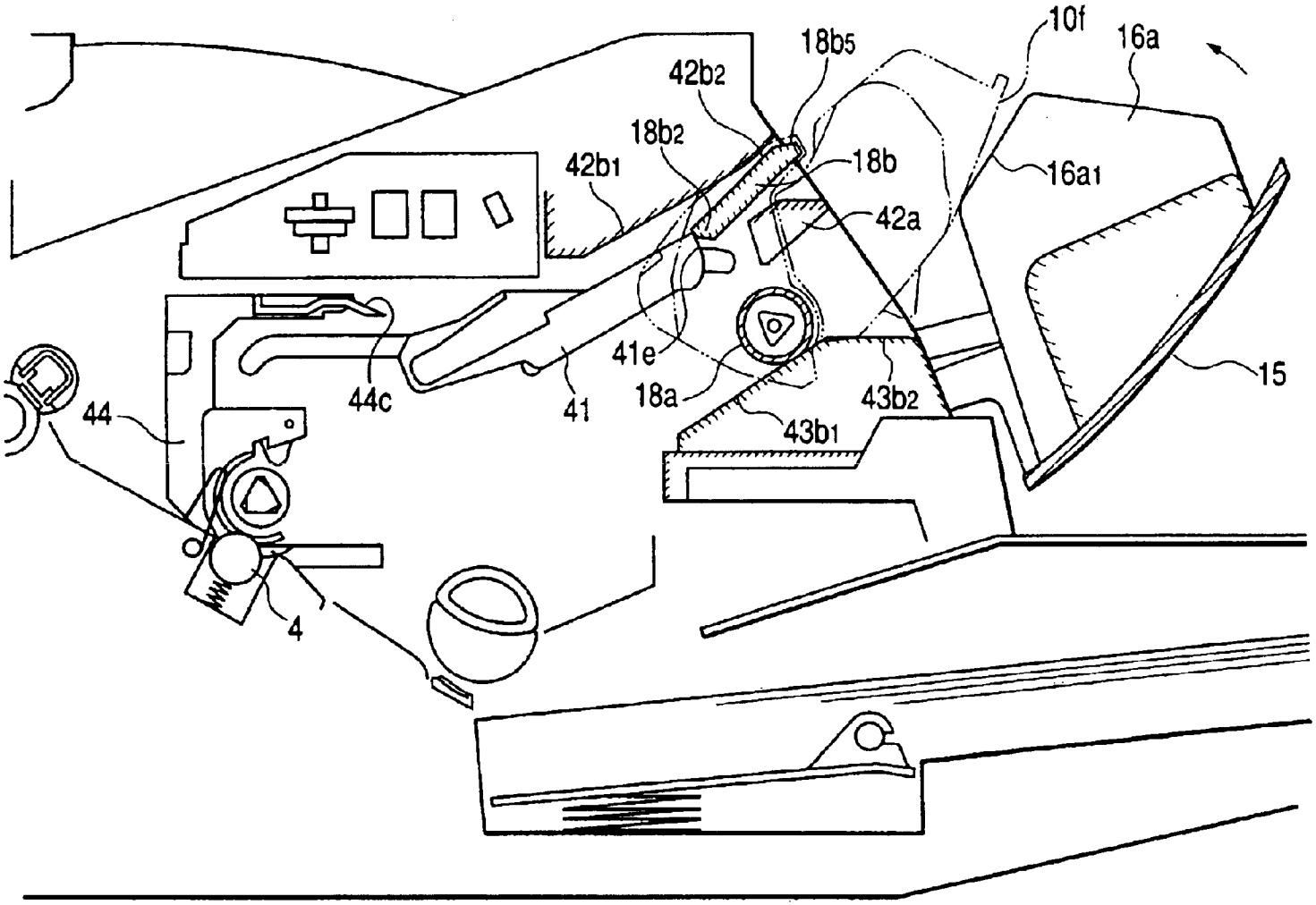
FIG. 16 is an explanatory view of the hindrance of insertion of the process cartridge into the process cartridge attachment/detachment mechanism during the opening and closing motion of a opening/closing cover.

On the mounting guide 18*b* which is a guided portion, the first main body guide 41 and the second main body guide 41 to be described later (hereinafter, referred to as moving guide 41)(see FIG. 16) and a top end portion 18*b*2 to be a top end in the inserting direction of the process cartridge of the mounting guide 18*b* are formed. This top end portion 18*b*2 makes a circular arc joined to the bottom surface 18*b*1 larger than the circular arc joined to the upper surface 18*b*6. On a rear end lower angle portion 18*b*3 to be a rear end angle portion of the inserting direction of the bottom surface 18*b*1, an inclined plane portion 18*b*4 where a contained angle with the bottom surface 18*b*1 was made an acute angle is formed. The rear end portion in the inserting direction of the upper surface comprises an orthogonal surface 18*b*5 orthogonal to the upper surface 18*b*6.

A center of gravity of the process cartridge is positioned between the top end and the rear end of the mounting guide 18*b* and, when the process cartridge B is supported by the rear end of the mounting guide 18*b*, it is allowed to always maintain a state of descending frontward.

In the present embodiment, the mounting guide 18*b* is provided above the positioning guide 18*a* at the side surface of the cleaning frame body 11*d*. The top end portion 18*b*2 of the mounting guide is located downstream side of the mounting direction rather than a vertical plane which passes through the rotation axis of the photosensitive drum 7 in the center of the positioning guide 18*a*. However, the mounting guide 18*b*, if this condition is satisfied, can be provided on the toner developing frame body 10*f* or a holder member 10*g*, which is provided on its side.

For the process cartridge B of the present embodiment, a drum shutter 12 which can integrally cover a transfer opening portion 9*a* opposing to the transfer roller 4 of the photosensitive drum 7 and an exposure opening 9*b* is rotatably provided on the cleaning frame body 11*d*.

Next, the constitution of the drum shutter 12 will be described.

As shown in FIGS. 1 and 2, the drum shutter 12 has a drum protective portion 12*a*, which can cover the transfer opening 9*a* in which the photosensitive drum 7 abuts against the transfer roller 4. The drum shutter 12 comprises a rotation axis 12*b* and is rotatably supported in the vicinity of the exposure opening 9*b*, of the cleaning frame body 11*d*. On the rotation axis 12*b*, a sliding portion 12*b*1 which is positioned at both ends of the rotation axis 12*b*, and slides with the cleaning frame body 11*d*, a large diameter portion 12*b*2 which is made larger than the sliding portion 12*b*1 positioned in the portion hung on the exposure opening 9*b* which connects the sliding portion 12*b*1 at both ends of the rotation axis 12*b* and an exposure shutter portion 12*b*3 which blocks the exposure opening 9*b* when the drum shutter 12 is in a state of being closed on the large diameter portion 12*b*2 are provided.

The outer side of the large diameter portion 12*b*2 of the rotation axis 12*b* is connected with one end of connecting portions 12*c* arranged left and right at two places, and the other end is connected to both ends of the drum protective portion 12*a*.

On the right side of the large diameter portion 12*b*2 of the rotation axis 12*b*, a cam portion 12*d* (see FIG. 3) protruded on the upper side of the process cartridge is arranged. On the connecting portion 12*c* of the right side of the drum shutter 12, a rib 12*e* protruded outside is formed. This rib 12*e* is housed in a shutter guide 44*c* of a fixed guide 44 (see FIG. 17) and maintains the drum shutter 12 in an opened state. The drum shutter 12 of the present embodiment integrally forms the above described portion by resin. Now, with respect to the longitudinal relationship between the mounting guide 18*b* on the right side and the cam portion 12*d*, the rib 12*e*, the mounting guide 18*b*, the rib 12*e* and the cam portion 12*d* are arranged in that order from the outer side in the longitudinal direction of the process cartridge.

The drum shutter 12 is biased in a direction in which the drum shutter 12 covers the photosensitive drum 7 by a spring force of a helical torsion spring (not shown). By this way, in a state of the process cartridge B being taken out of the apparatus main body 14, the drum shutter 12, as shown by an alternate long and two short dashes line of FIG. 2, maintains a closed state of covering the transfer opening 9*a* of the photosensitive drum 7. On the other hand, in a state capable of forming an image inside the apparatus main body 14, the drum shutter 12 rotates by drum shutter opening/closing means and, as shown by a continuous line of FIG. 2, exposes the transfer opening 9*a* and takes such a posture that the photosensitive drum 7 and the transfer roller 4 can abut against each other.

(Closing Cover and Back Cover)

Figure 5:
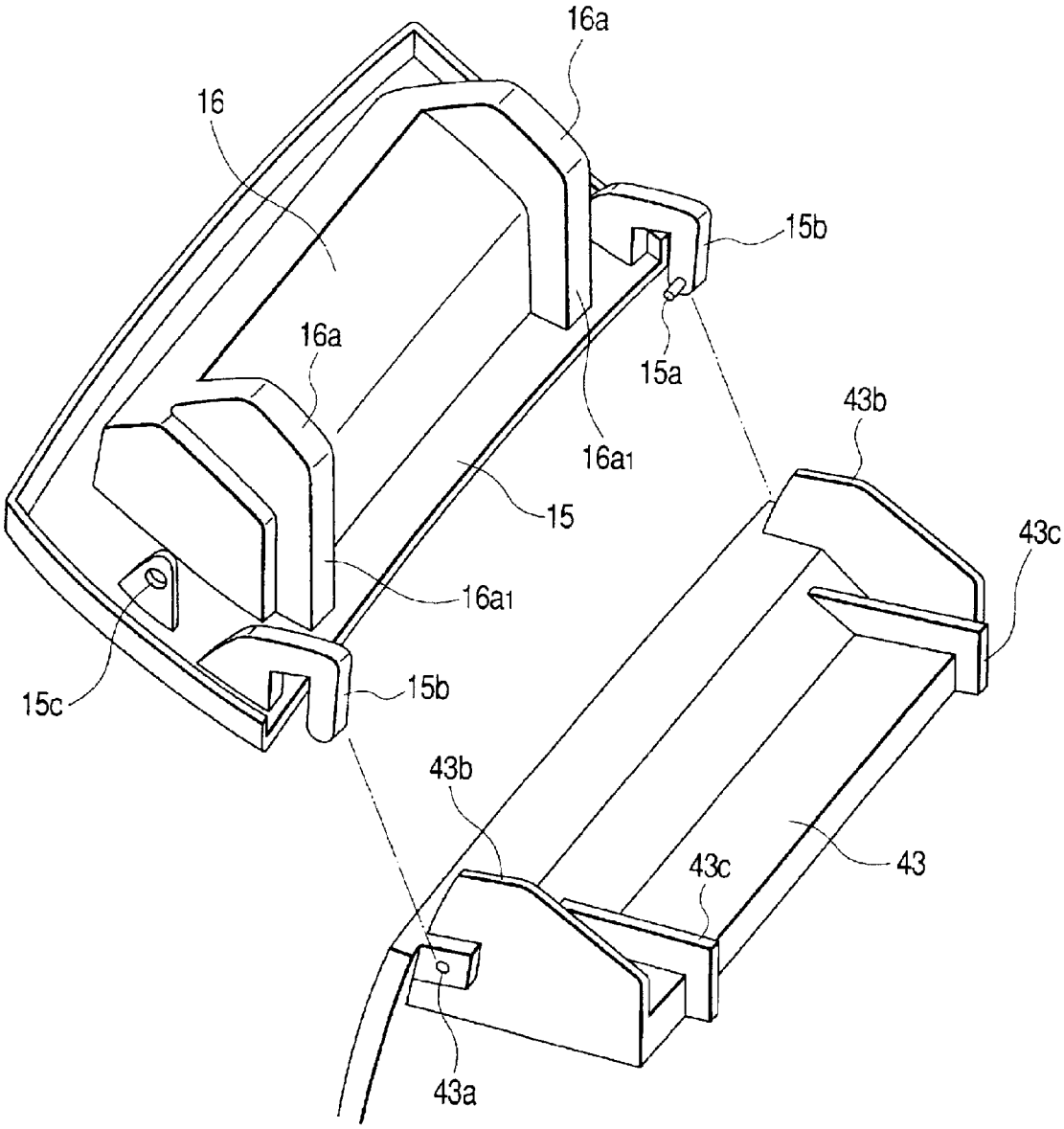
FIG. 5 is a perspective view of an opening/closing cover and a front cover.

As shown in FIG. 5, an opening/closing cover 15 is provided on its back with two hinges 15*b* having a center boss 15*a* which forms a rotation central axis on the top end and two linkage holes 15*c* to which an axis 15*b* of the linkage plate 51 fits in the vicinity of both ends. The back of the opening/closing cover 15 is fixed with a back cover 16 to improve rigidity of the opening/closing cover. This back cover 16 has a convex portion 16*a* (regulating guide) in the vicinity of both ends and functions as a rough guide when the process cartridge B is mounted inside the image forming apparatus.

(Front Guide)

As shown in FIG. 5, a front guide 43 is fixed between the right and left inner plates 40. The front guide 43 has a support hole 43*a* formed to rotatably support the center boss 15*a* of the opening/closing cover 15. This front guide 43 is provided with two side guides 43*b* and abutting ribs 43*c* in the longitudinal direction in the vicinity of both ends.

The side guide 43*b* has an inner surface set in the same longitudinal position as the inner surface of the moving guide 41 and performs the guiding of the positioning guide 18*a* of the process cartridge and the guiding of the longitudinal position of the process cartridge B. Furthermore, the abutting rib 43*c* abuts against the bottom surface 10*f*4 of the toner developing frame body 10*f* of the process cartridge longitudinally inside the front guide 43.

(Attachment and Detachment of Process Cartridge to and from Main Body)

Next, the attachment/detachment operation of the process cartridge B by the hand of an operator to and from the image forming apparatus A having a process cartridge attachment/detachment mechanism will be described by using FIGS. 7 to 16.

Figure 7:
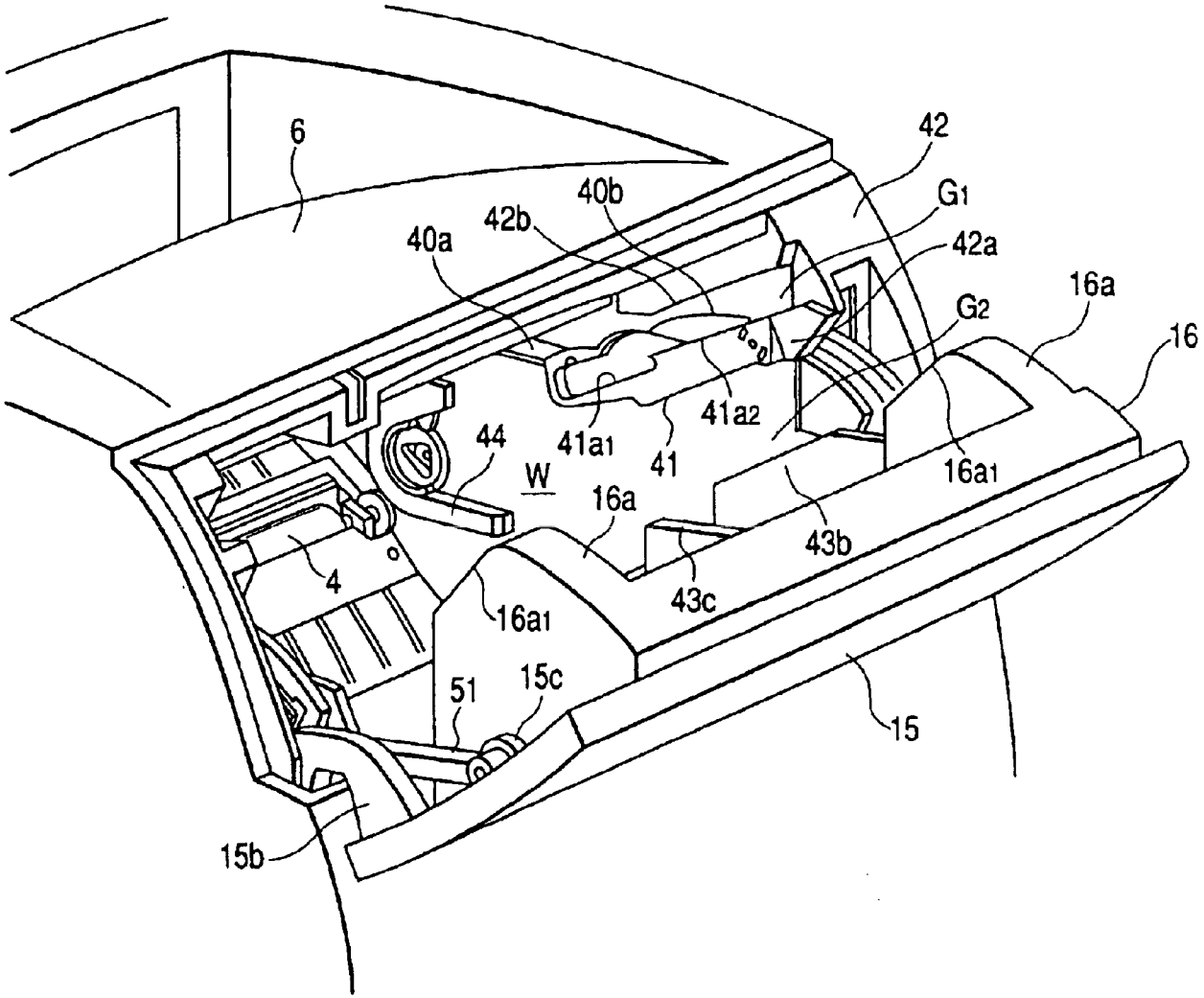
FIG. 7 is a perspective view of a cartridge attachment/detachment mechanism.

When the opening/closing cover 15 of the image forming apparatus main body A is completely opened (in a fully opened state), an opening W to attach and detach the process cartridge appears. In this state, as shown in FIG. 7, the moving guide 41 appears in a descended posture to the inner side in the inserting direction of the process cartridge. Auxiliary guides 42 are fixed to an inner side plate 40 substantially symmetrically left and right on the upstream side in the inserting direction of the moving guide 41.

Figure 8:
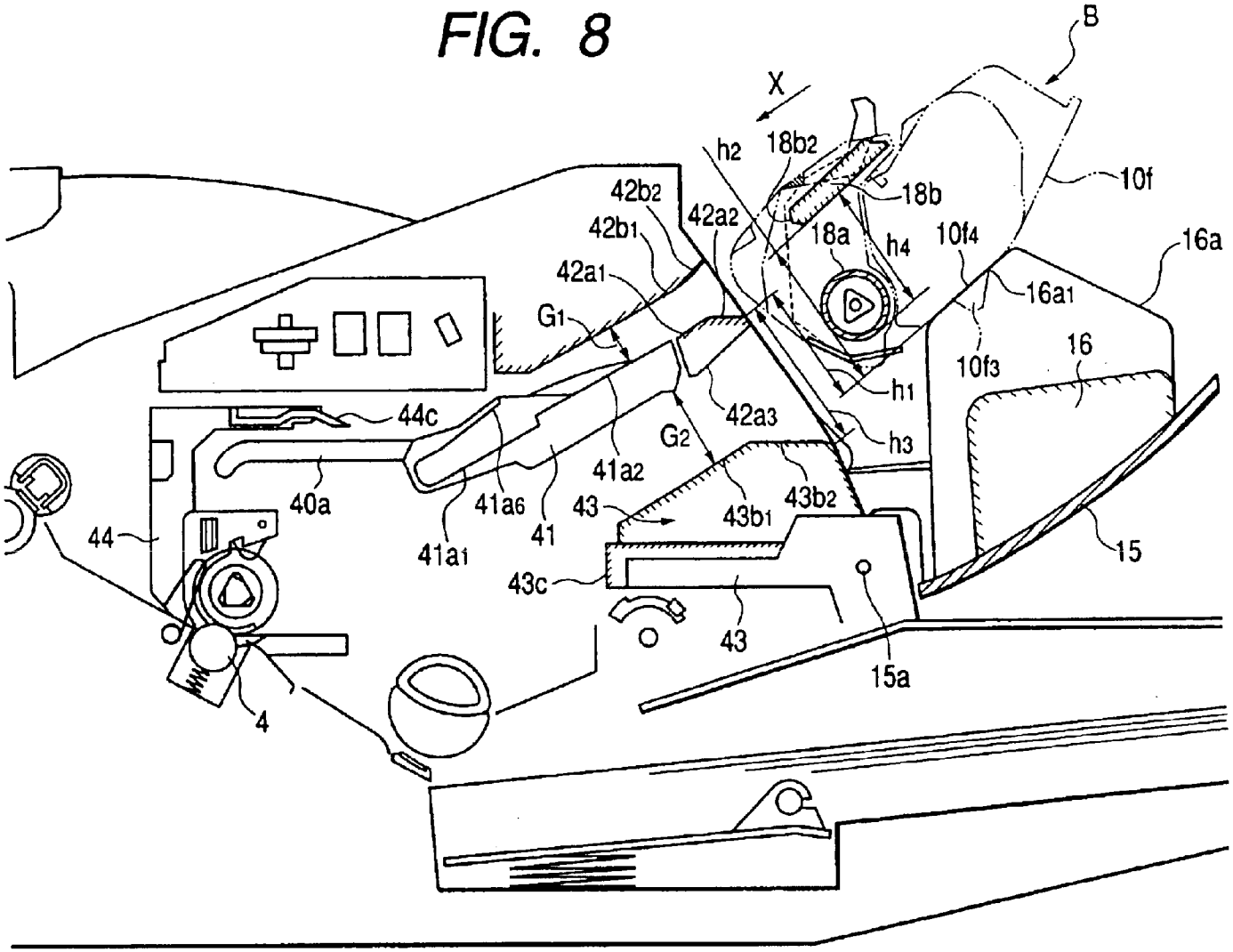
FIG. 8 is an explanatory view of a process cartridge inserting operation into a process cartridge attachment/detachment mechanism.

As can be seen still better by referring to FIG. 8, the auxiliary guide 42 has a attachment/detachment auxiliary portion 42*a* stretching to the rear end of the moving guide 41 and an upper regulating portion 42*b* having a surface stretching to an upper surface 41*a*6 of the moving guide 41.

The attachment/detachment auxiliary portion 42*a* is provided with a front guide surface 42*a*1 stretching to a guide surface 41*a*2, an introducing guide surface 42*a*2 stretching to the front guide surface 42*a*1 and having an inclination gentler than the front guide surface 42*a*1 and made nearly flat and a lower guide surface 42*a*3 lying under both of the guide surface 42*a*1 and the introducing guide surface 42*a*2 and having an inclination acuter than the front surface and facing to the bottom surface of the moving guide 41.

On the upper regulating portion 42*b*, an upper regulating surface 42*b*1 nearly joining to an upper surface 41*a*6 of the moving guide 41 and an upper introducing guide surface 42*b*2 stretching to the upper regulating surface 42*b*1 and nearly parallel to a lower guide surface 42*a*3 and inclined upward from the upper regulating surface are provided.

The above described side guide 43*b* of the front guide 43 has an inclined plane or surface 43*b*1 whose inclination is made slightly acuter rather than parallel to the guide surface 41*a*2 of the moving guide 41 and a horizontal plane 43*b*2 stretching to the inclined surface 43*b*1 and provided at the opening/closing cover 15 side.

For this reason, on inner surfaces of the inner side plates 40 left and right of the opening W which appear when the opening/closing cover 15 is opened, two pieces of guide grooves appear, which are an upper guide G1 with an entrance side made larger by the introducing guide 42*a*2 and the upper introducing guide surface 42*b*2 and inclined downward to the inner side in the inserting direction constituted among the upper regulating portion 42*b* of the auxiliary cover 42, the attachment/detachment auxiliary portion 42*a* and the moving guide 41 and a guide G2 with an entrance side made larger by a lower guide surface 42*a*3 and a horizontal plane 43*b*2 and inclined downward to the inner side in the inserting direction constituted among the attachment/detachment auxiliary portion 42*a*, the moving guide 41 and the side guide 43*b*.

The opening/closing cover 15, as shown in FIG. 5, opens downward since the center boss 15 lies under the lower side of the cover and the back cover 16 faces on the opening W. On a convex portion 16a provided on the back cover 16, a rough guide surface 16*a*1 inclined downward to the cartridge inserting direction is formed.

The process cartridge B is provided on both side of the cartridge frame body CF with, as described above, the positioning guide 18*a* formed coaxially with the rotation axis of the photosensitive drum 7 and a rib shaped mounting guide 18*b* formed along the removable direction of the process cartridge. The bottom surface of the toner developing frame body 10*f* is provided with a protruding portion 10*f*3 in the vicinity of both sides of the longitudinal direction.

When the process cartridge B is inserted into the opening W, the mounting guide 18*b* of the process cartridge B is fitted to the upper guide G1 of the side surface of the opening W and the positioning guide 18*a* is fitted to the under guide G2 of the side surface of the opening W, and the mounting guide 18*b* is inserted until it hits against the inner part of the guide groove 41*a* of the moving guide 41. At this time, the convex portion 16*a* of the back cover 16 limits an inserting position of the process cartridge B to a certain degree and functions as a rough guide to allow the mounting guide 18*b* and the positioning guide 18*a* of the process cartridge to be easily guided to the upper guide G1 and the under guide G2. This allows a distance h1 from the rough guide surface 16*a*1 to the apex of the opening/closing cover side of the introducing guide surface 42*a*2 and a distance h2 from the bottom surface of the toner developing frame body 10*f* to the point of intersection between the bottom surface 18b1 and the top end 18b2 of the mounting guide 18b to be set to:

$$h1<h2$$

Further, this allows a distance h3 from the apex of the opening/closing cover side of the introducing guide surface 42a2 to the apex of the opening/closing cover side of the horizontal plane 43b2 of the side guide 43b and a distance h4 from the point of intersection between the bottom surface 18b1 and the top end 18b2 of the mounting guide 18b to the bottom surface of the positioning guide 18a to be set to:

$$h3>h4$$

Figure 9:
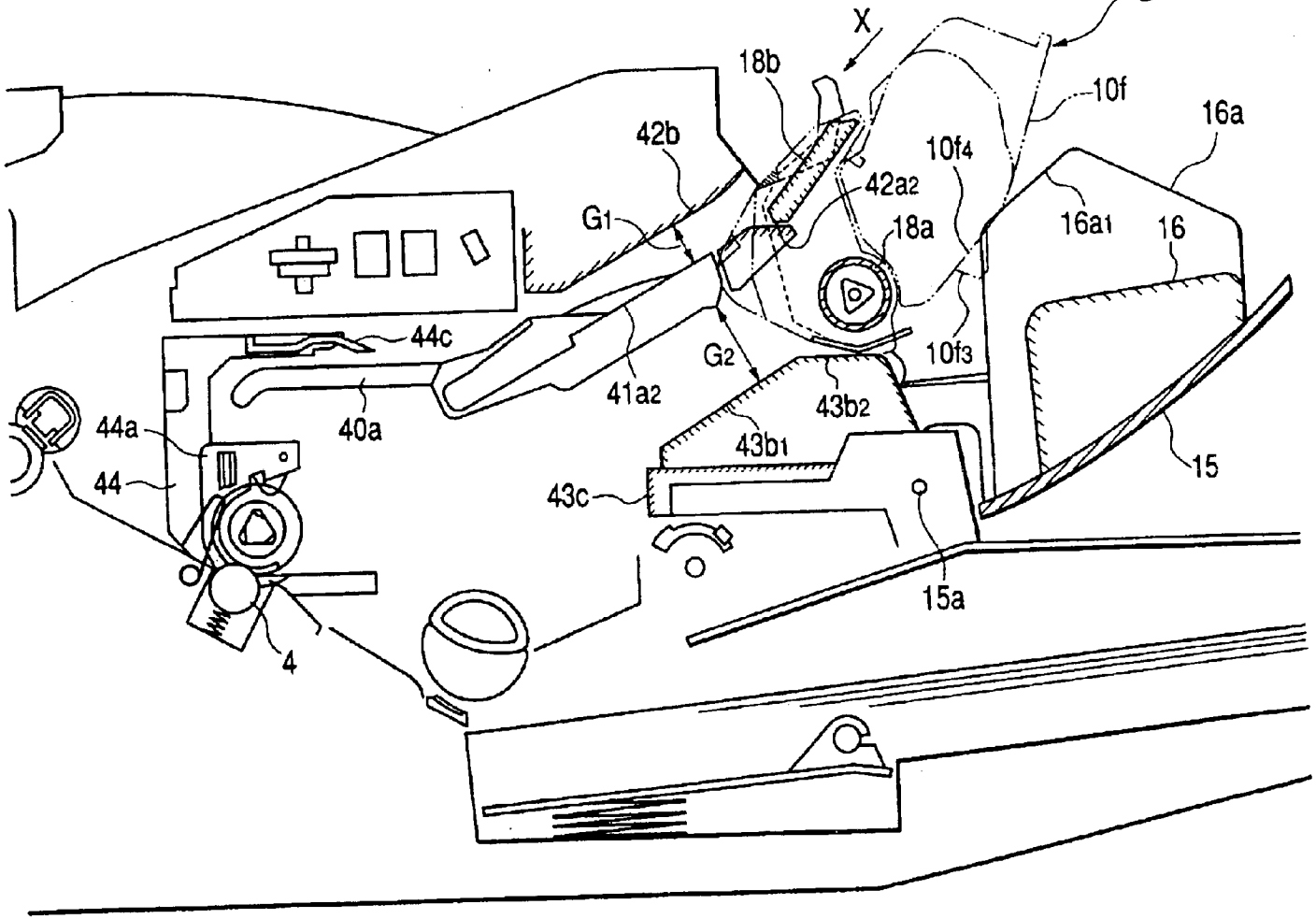
FIG. 9 is an explanatory view of a process cartridge inserting operation into a process cartridge attachment/detachment mechanism.

By this way, as shown in FIGS. 8, 9, when the bottom surface of the toner developing frame body 10f of the cartridge B is laid parallel to the rough guide 16a1 provided on the convex portion upper surface, the mounting guide 18b is guided to the upper guide G1 entrance and the positioning guide 18a to the under guide G2 entrance, automatically. Note that this position is a position to insert or remove the cartridge B on the apparatus main body 1.

Figure 10:
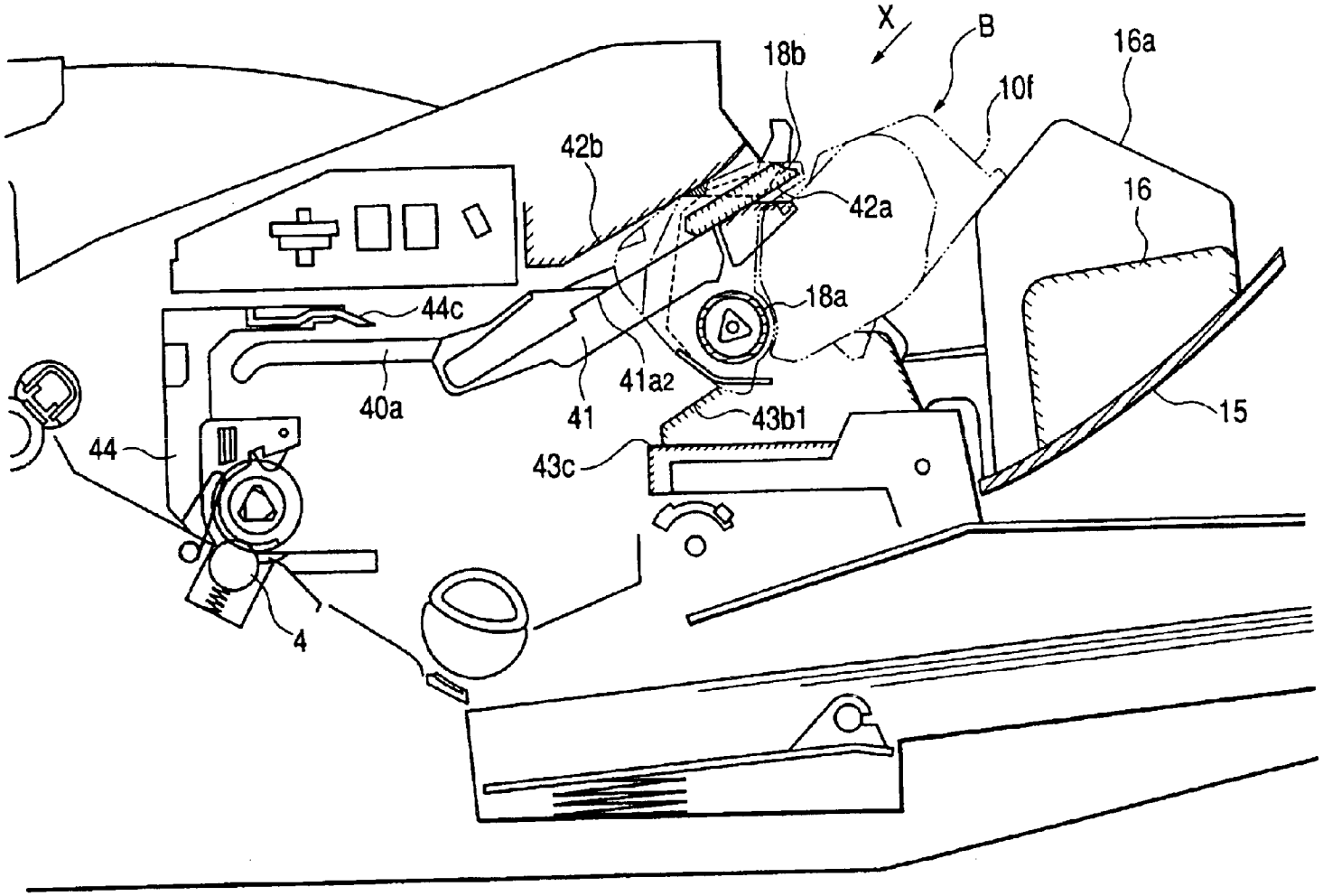
FIG. 10 is an explanatory view of a process cartridge inserting operation into a process cartridge attachment/detachment mechanism.

The convex portion 16a, as shown in FIG. 10, is brought into contact with the toner developing frame body 10f until the mounting guide 18b hangs on the guide surface 41a2 of the moving guide 41 and the process cartridge B maintains a posture of descending frontward in the mounting direction so that the process cartridge B is easily moved to the inner part of the guide groove 41a of the moving guide 41 by its own weight.

The convex portions 16a are provided at both ends in the longitudinal direction of the back cover 16. The reason why the center portion is controlled to be low is to secure a space for the hand of the user to easily enter at the removal time of the process cartridge or during jam processing. That is, the opening W, which appears when the opening/closing cover 15 is opened, is made of a form to provide both an area to mount the process cartridge B and a space easily accessible by the user to the inside of the image forming apparatus.

Figure 13:
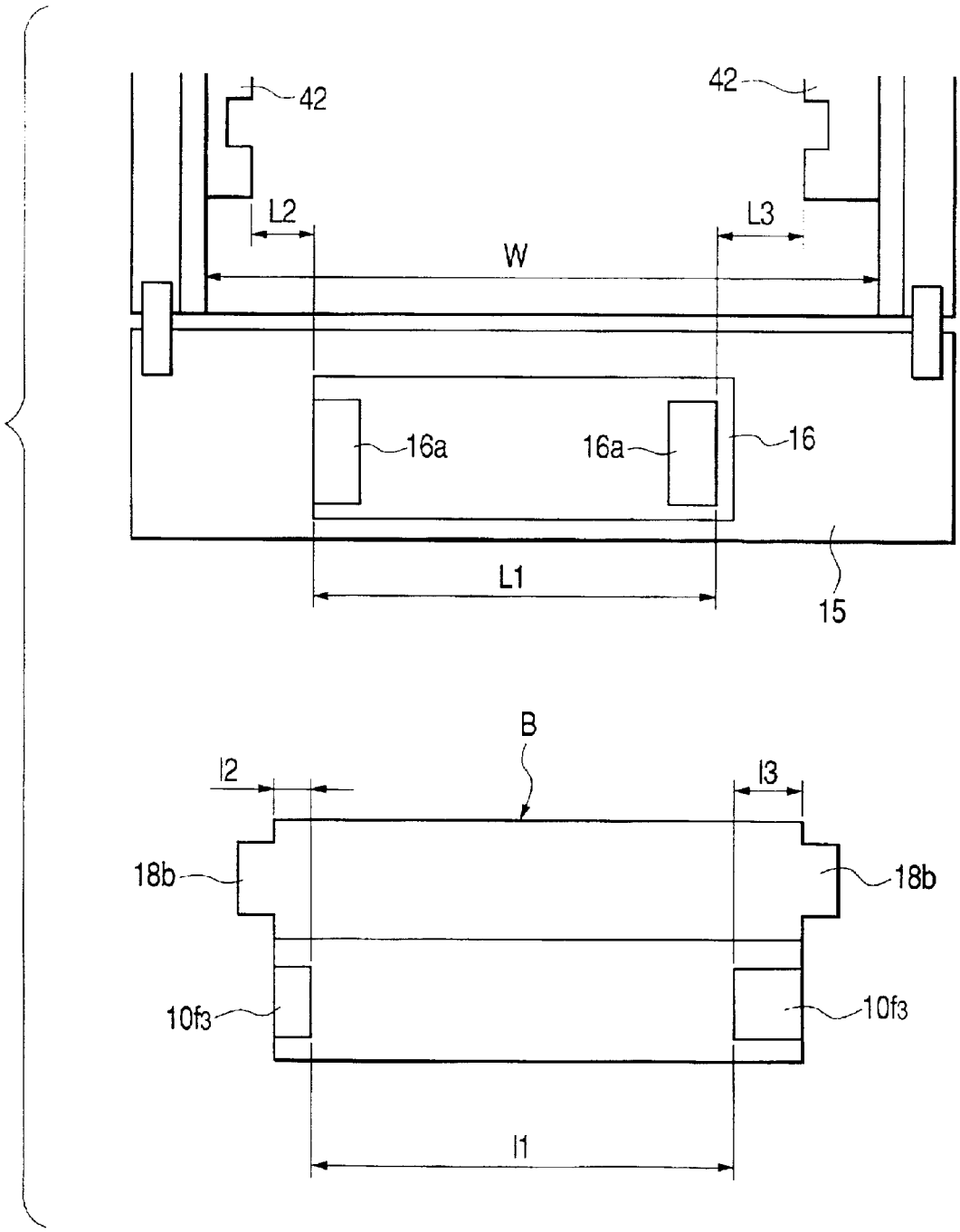
FIG. 13 is an explanatory view of a positional relation in the longitudinal direction of a back cover convex portion in an opening W and a protruding portion of the process cartridge.

Here, the physical relationship between the convex portion 16a in the opening W and the longitudinal direction of the process cartridge will be described by using FIG. 13.

The relationship among a spacing L1 of the outer sides of the convex portions 16a of the back cover 16, a spacing L2 between the convex portion outer side surface of the left side and the inner side of the left side auxiliary guide and a spacing L3 between the convex portion outer side of the right side and the inner surface of the right side auxiliary guide, a relation among a spacing l1 of the inner side of the protruding portion 10f3 of the process cartridge B, a spacing l2 between the left side protruding portion inner side surface and the left side side surface of the cartridge frame body CF and a spacing l3 of the right side protruding portion inner side surface and the night side side surface of the cartridge frame body CF is:

$$L1<l1, \tag{1}$$

and $$L2\approx l2+(l1-L1)/2+((L1+L2+L3)-(l1+l2+l3))/2 \tag{2}$$

$$L3\approx l3+(l1-L1)/2+((L1+L2+L3-(l1+l2+l3)/2 \tag{3}$$

Accordingly, from the above (1), the convex portions 16a at both ends are settled between the protruding portions 10f3 of the toner developing frame body bottom surface, and from the above (2), (3), by fitting the protruding portions 10f3 to the convex portions 16a, there arises a relationship by which a positioning to the opening W in the longitudinal direction of the process cartridge B can be made approximately.

By utilizing the convex portion 16a of the back cover 16 formed by this way, the mounting guide 18b of the process cartridge B can be guided to the upper guide G1 and the positioning guide 18a to the lower guide G2, smoothly. Since the front guide surface 42a1, which is the bottom surface of the upper guide G1, and the guide surface 41a are formed by descending frontward, and the rear end of the mounting guide 18b is provided further backward than a center of gravity position of the process cartridge, the process cartridge B takes a posture of descending frontward, and the process cartridge B is guided to the inner part of the moving guide 41 by its own weight.

The inclined plane 43b1 of the side guide 43b which is the bottom surface of the under guide G2 is slightly acuter than the guide surface 41a2 in the inclination. Hence, as can be understood by referring to FIG. 10, when the process cartridge B is inserted, the positioning guide 18a separates from the inclined plane 43b1 of the side guide 43b. For this reason, when the process cartridge B is inserted from the opening W, the mounting guide 18b is received by the moving guide 41.

Figure 11:
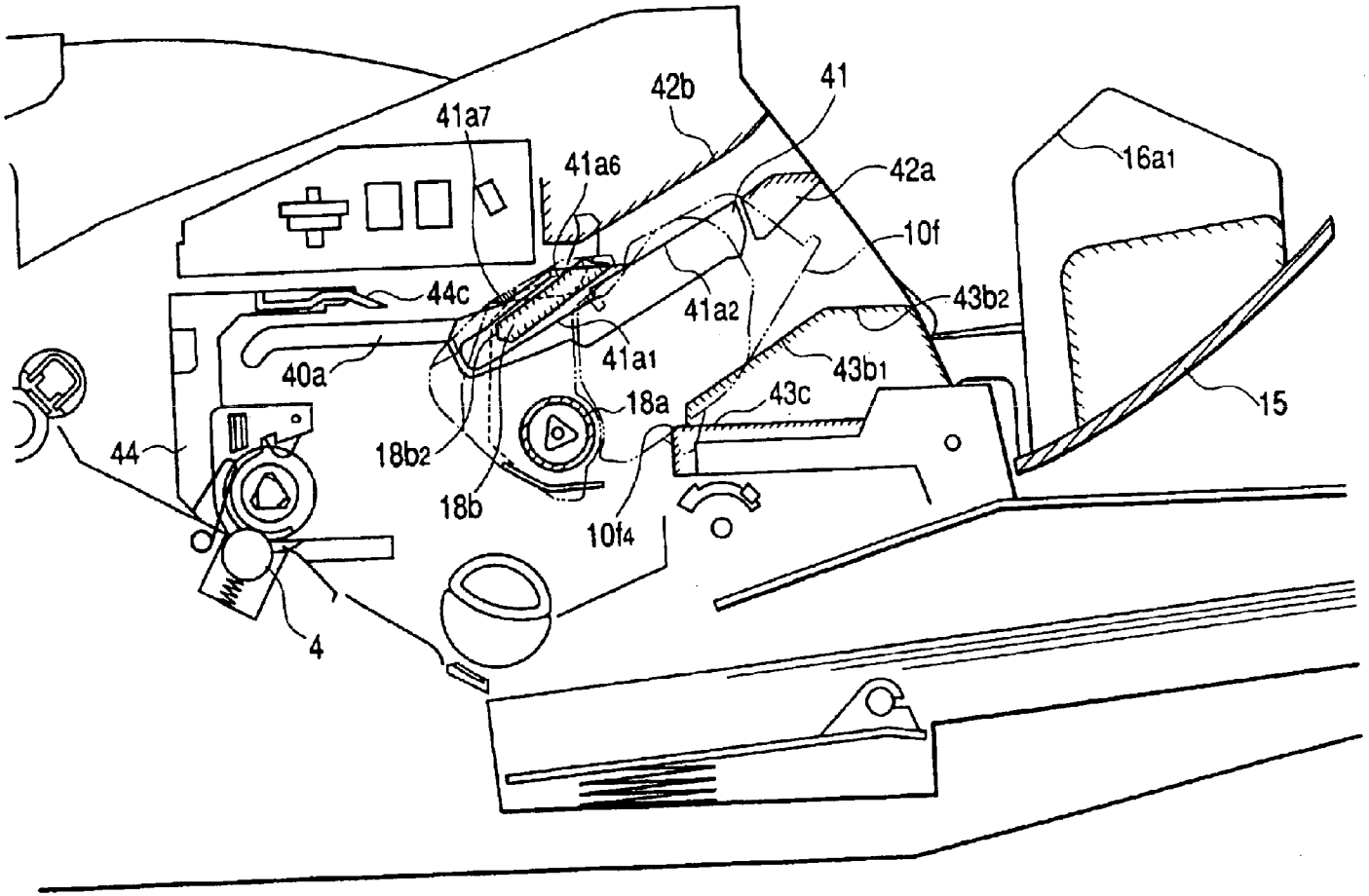
FIG. 11 is an explanatory view of a process cartridge inserting operation into a process cartridge attachment/detachment mechanism.
Figure 12:
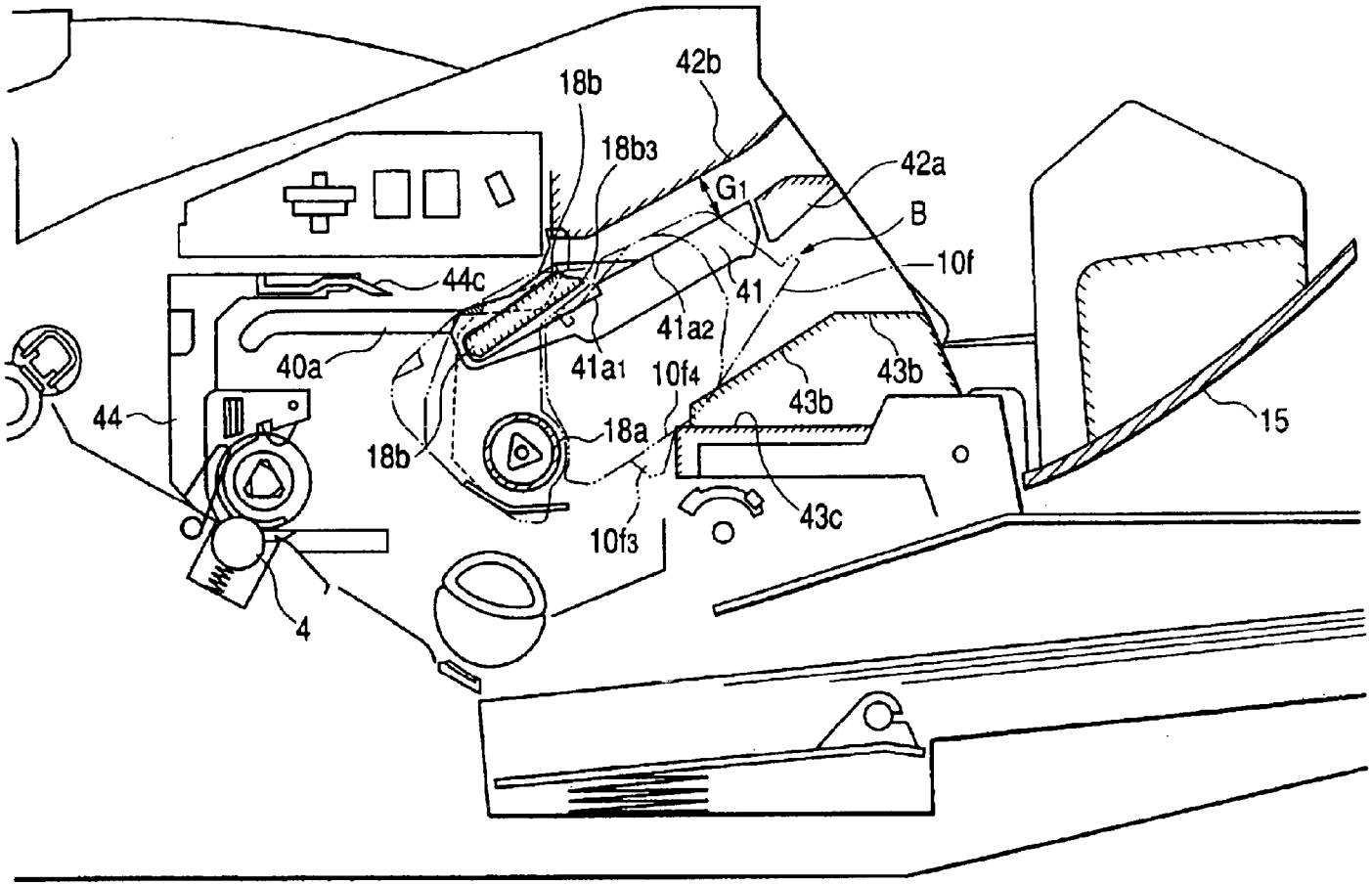
FIG. 12 is an explanatory view of a process cartridge inserting operation into a process cartridge attachment/detachment mechanism.

When the process cartridge B received by the guide surface 41a2 of the moving guide 41 is inserted further, the top end 18b2 of the mounting guide 18b abuts against an upper surface inclination 41a7 of the moving guide 41 (see FIG. 11). The top end 18b2 of the mounting guide 18b is a smooth circular arc, and the bottom surface of the upper surface inclination 41a7 is a receiving surface 41a1 which came down from the guide surface 41a2. Therefore, the process cartridge B changes to a posture of strengthening the inclination further than the mounting time due to operation of the upper inclination 41a7 and is inserted into the inner side of the guide groove 41a and, as shown in FIG. 12, the mounting guide top end 18b2 is brought into contact with the inner side of the receiving surface 41a1 so as to complete the mounting of the process cartridge B to the moving guide 41. As can be understood by the description provided up to here, the mounting of the process cartridge B by the operator to the moving guide 41 is performed by lowering the process cartridge B obliquely to the lower side in the inserting direction.

When the process cartridge B changes a posture to the direction to strengthen the inclination, as shown in FIG. 11, the top end of the abutting rib 43c provided on the front guide 43 abuts against the bottom surface 10f4 of the toner developing frame body 10f, with this abutting rib 43c and the bottom surface 10f4 brought into contact, the process cartridge B changes to a posture of descending frontward.

In a state of having completed the insertion of the process cartridge B into the moving guide 41, a point at which the bottom surface 10f4 of the toner developing frame body 10f is brought into contact with the abutting rib 43c is set further backward in the inserting direction than the center of gravity position of the process cartridge B. Therefore, the process cartridge B takes a posture of lifting the toner developing frame body 10f, which becomes the rear side in the inserting direction at the completion time of the mounting. For this reason, as shown in FIG. 12, the process cartridge B which was inserted from the opening W has the under side of the top end 18b2 of the mounting guide 18b supported by the inner part side of the receiving surface 41a1 of the guide groove 41a, and the bottom surface 10f4 of the toner developing frame body 10*f* is supported by the abutting rib 43*c* of the front guide 43. Hence, the rear end lower angle portion 18*b*3 of the mounting guide 18*b* is lifted. The abutting rib 43*c* is set in such a manner that the rear end rear angle portion 18*b*3 of the mounting guide 18*b* has the same height as the guide surface 41*a*2 of the moving guide 41.

Here, the inclination of the guide surface 41*a*2 will be described.

When the inclination of the guide surface 41*a*2 is too gentle, the process cartridge B cannot be guided into the inner part of the moving guide 41 by its own weight and, therefore, the user has to push it into the inner part. On the contrary, when the inclination is too large, in the case where the user lets go his hold of the process cartridge B in the midst of inserting, an impact of dropping is great, thereby resulting in the risk of causing damage to the process cartridge B and the image forming apparatus main body 14. For this reason, it is desirable that the inclination is about 15° to 50° from the horizontal level. In the present embodiment, the inclined angle of the guide surface 41*a*2 is taken as about 26° from the horizontal level.

By this way, the moving guide 41 is mounted with the process cartridge B at a position (a first position) where the guide surface 41*a*2 of the guide groove 41*a* stretches to the front guide surface 42*a*1 of the auxiliary guide 42. The moving guide 41 takes, at a position where the process cartridge B can be mounted, that is, where the guide surface 41*a*2 is contiguous to the front guide surface 42*a*1, a posture (a first posture) of descending frontward to the direction where the mounting direction X of the process cartridge B to the guide groove 41*a* intersects the conveying direction of the recording medium 2 by the conveying means 3.

In the present embodiment, the moving guide 41 in the process cartridge attachment/detachment mechanism is constituted in such a manner that it moves by linking with opening and closing operation of the opening/closing cover 15. For this reason, when the rear end (the opening/closing cover side end surface) of the moving guide 41 is constituted such that it can be pushed by the process cartridge B, the moving guide 41 escapes into the inside of the image forming apparatus so that the mounting guide 18*b* of the process cartridge B cannot be inserted into the inside of the guide groove 41*a* of the moving guide 41. Hence, in the present embodiment, the auxiliary guide 42 which is fixed on the inner side plate 40 and has an attachment/detachment auxiliary portion 42*a* stretching to the rear end of the moving guide 41 is provided on the upstream side of the moving guide 41 in the inserting direction X of the process cartridge B. By this auxiliary guide 42, the above described problem is solved and the mounting guide 18*b* of the process cartridge B is reliably guided into the guide groove 41*a* of the moving guide 41.

Since the constitution is such that the process cartridge B is mounted on the moving guide 41 which moves by linking with opening and closing operation of the opening/closing cover 15, in a state of the opening/closing cover 15 in the midst of being closed, the moving guide 41 moves to the inside of the image forming apparatus. For this reason, a space is created between itself and the attachment/detachment auxiliary portion 42*a* of the auxiliary guide 42. When the closing amount of the opening/closing cover 15 is small and yet it is a space to such a degree that the mounting guide 18*b* can stride over, it is possible to perform the mounting of the process cartridge B. However, when this space is widened to some degree, it is not possible for the mounting guide 18*b* of the process cartridge B to be inserted into the guide groove 41*a* of the moving guide 41 and, when the space is further widened, it is assumed that the mounting guide 18*b* comes into this space and slips into the inside of the image forming apparatus.

Therefore, in the present embodiment, the insertion of the process cartridge B in a state of the opening/closing cover 15 in the midst of being closed is prevented by the convex portion 16*a* of the back cover 16.

Figure 14:
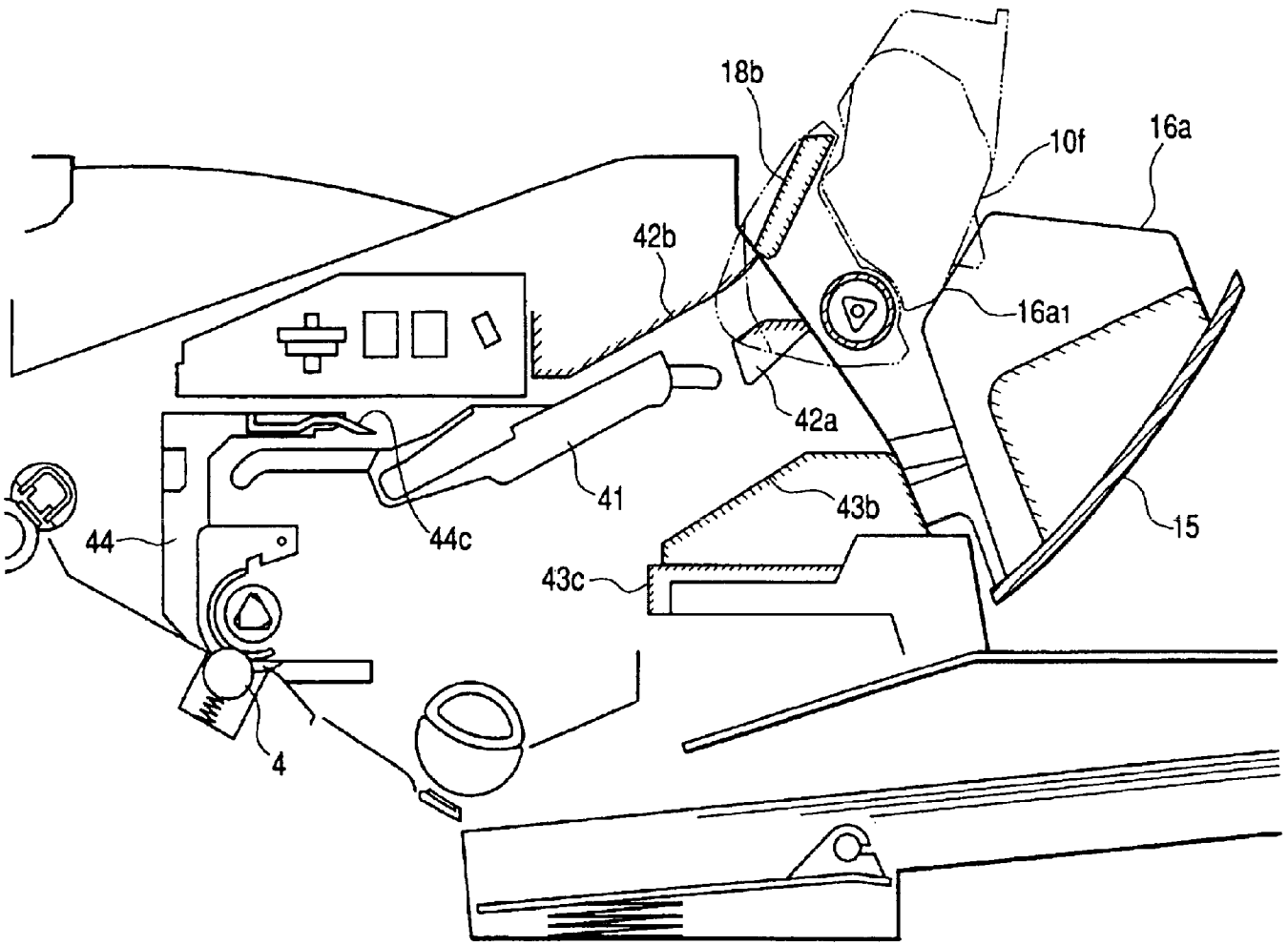
FIG. 14 is an explanatory view of the hindrance of insertion of the process cartridge into the process cartridge attachment/detachment mechanism during opening and closing motion of a opening/closing cover.

That is, when the closing amount of opening/closing cover 15 is large, as shown in FIG. 14, the convex portion 16*a* of the back cover is close to the upper regulating portion 42*b* and there remains no space mountable for the process cartridge B and, therefore, it is not possible to insert the process cartridge B.

Figure 15:
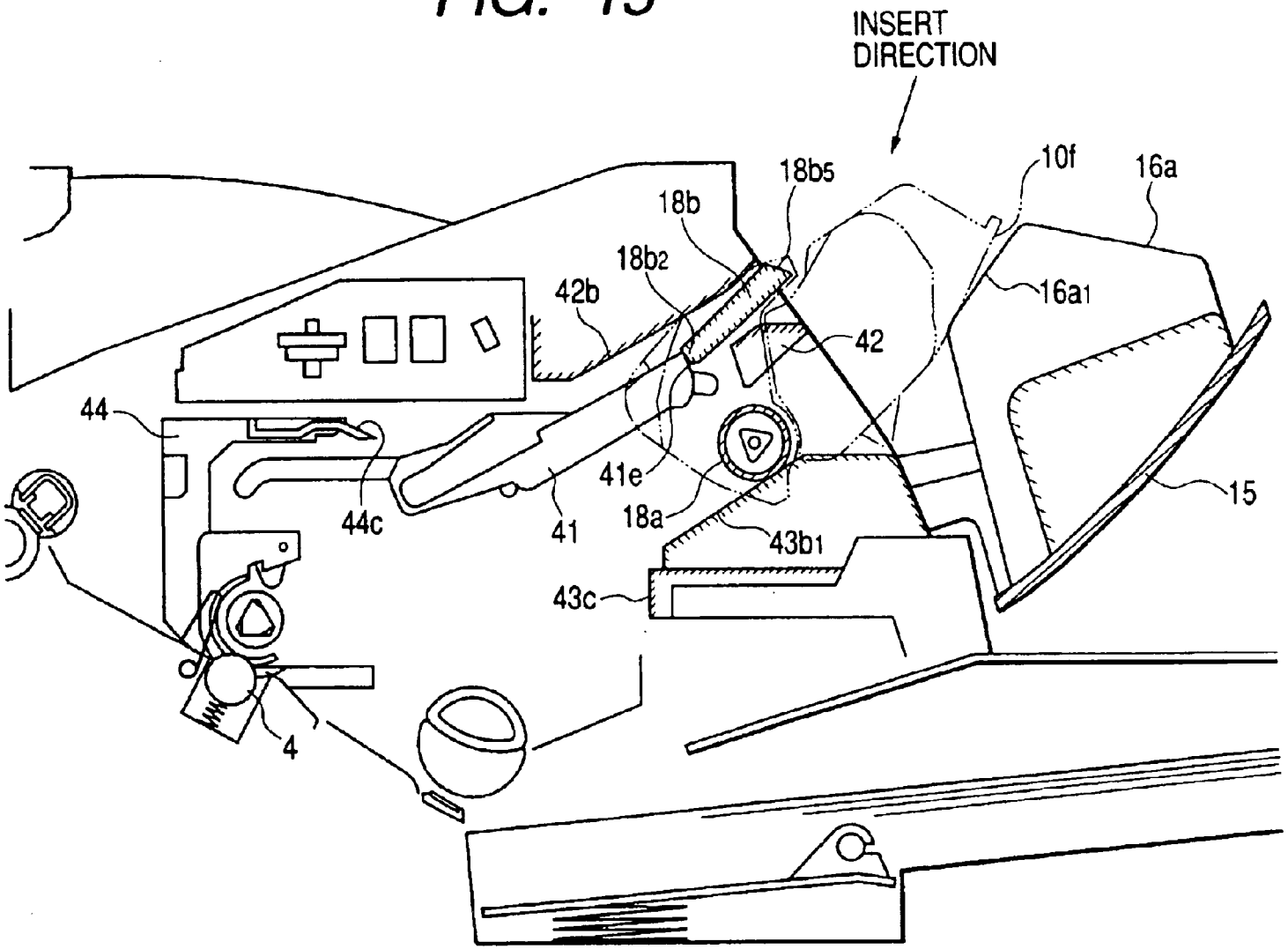
FIG. 15 is an explanatory view of the hindrance of insertion of the process cartridge into the process cartridge attachment/detachment mechanism during an opening and closing motion of a opening/closing cover.

As shown in FIG. 15, when the opening/closing cover 15 is in the midst of being closed and the process cartridge B is in a state of being able to be inserted, the convex portion 16*a* invades into the original removable direction X due to rotation of the opening/closing cover 15. Further, the rough guide surface 16*a*1 of the back cover 16 has an angle acuter than usual. Hence, the process cartridge B cannot be inserted except by an acuter angle than usual.

When the process cartridge is inserted at an acute angle so that the bottom surface of the process cartridge B is allowed to run parallel to the rough guide surface 16*a*1 of the convex portion 16*a* in a state of the opening/closing cover 15 in the midst of being closed, the guide surface 41*a*2 of the moving guide 41 and the front guide surface 42*a*1 of the auxiliary guide 42 become discontinued. For this reason, the top end surface 18*b*2 of the mounting guide 18*b* is brought into contact with the rear end 41*e* of the moving guide 41. At this time, the positioning guide 18*a* is brought into contact with the inclined plane 43*b*1 of the side guide 43*b* so that the bottom surface of the toner developing frame body 10*f* is brought into contact with the convex portion 16*a* of the back cover and the posture of the process cartridge is limited.

When three places such as the top end 18*b*2 of the mounting guide 18*b* and the rear end 41*e* of the moving guide 41, the positioning guide 18*a* and the inclined plane 43*b*1 of the side guide 43*c* and the bottom surface of the toner developing frame body 10*f* and the convex portion 16*a* are in a state of abutting against one another and, further, the opening/closing cover 15 is closed, the moving guide 41 moves to the inside of the image forming apparatus and the convex portion 16*a* of the back cover 16 also rotates upward. Accordingly, the process cartridge B rotates counter-clockwise. For this reason, a joined angle portion between the upper surface rear end and an orthogonal surface 18*b*5 of the mounting guide 18*b* abuts against the upper guide surface 42*b*2 of the auxiliary guide 42 and it is not possible to close the opening/closing cover 15 any more (see FIG. 16). That is, since the opening/closing cover 15 can be no longer closed even when the process cartridge is inserted from a state where the opening/closing cover 15 is in the midst of being closed, the problem of the mounting failure of the process cartridge can be prevented before it happens.

Here, even when the process cartridge B is inserted from a state where the above described opening/closing cover 15 is in the midst of being closed and the process cartridge B is in a state of being unmovable, when the opening/closing cover 15 is rotated again in an opening direction, the moving guide 41 moves to the opening W side and pushes the top end surface 18*b*2 of the mounting guide 18*b* so as to pull out the process cartridge B. When the space between the guide surface 41*a*1 of the moving guide 41 and the front guide surface 42*a*1 of the auxiliary guide 42 becomes smaller and the mounting guide 18*b* strides over the space, the mounting guide 18*b* can be settled in the guide groove 41*a* and the mounting of the process cartridge B can be performed.

(Opening and Closing Mechanism of Drum Shutter)

Up to here, a state of the process cartridge moving by linking with the rotation of the opening/closing cover 15 has been described. Hereinafter, the opening and closing operation of the drum shutter 12 followed by its movement will be described.

In the present invention, the opening and closing operation of the drum shutter 12 is not performed at the stage (FIGS. 8 to 12) where the process cartridge B is mounted on the moving guide 41, but is performed at the stage (FIGS. 17 to 22) where the process cartridge B moves into the inside of the main body followed by the rotation of the opening/closing cover 15.

This is to prevent a situation, wherein, when the drum shutter 12 is opened at the stage where the process cartridge B is mounted on the main body, a resistance to open this drum shutter 12 becomes an inserting load and the mounting guide 18*b* of the process cartridge is stopped before it is inserted into the receiving portion 41*a*1 deep of the guide groove of the moving guide 41.

For this reason, an operation which becomes the inserting load is eliminated in the mounting operation of the process cartridge B to the main body to be performed by the user and the opening and closing of the drum shutter 12 is performed at the stage where the process cartridge B is moved by the closing operation of the opening/closing cover 15.

When the process cartridge B is moved by linking with the opening and closing operation of the opening/closing cover 15, the drum shutter 12 rotatably supported by the process cartridge B rotates. Then, by exposing the transfer opening of the photosensitive drum 7 and the exposure opening, the process cartridge B is put into a state of being able to form an image.

Although the rib 12*e* to keep an opened posture of the drum shutter 12, as shown in FIG. 3, is exposed on the upper surface of the cleaning frame body 11*d*, it is settled within the envelope of the cleaning frame body, and the end surface of the longitudinal direction is settled more inside than the side surface opposing to the moving guide 41 of the cleaning frame body 11*d*.

An abutting surface of the rib 12*e* against a shutter guide 44*c* (the second abutting portion) of the fixed guide 44 is on the side facing on the cleaning frame body 11*d* and appears when the drum shutter 12 is opened.

By this way, the rib 12*e* (the second protrusion) for which the drum shutter 12 decides an opened posture inside the image forming apparatus is within the envelope of the cleaning frame body 11*d* in the sectional direction in a state of the process cartridge B being driven out of the image forming apparatus and the drum shutter 12 being closed. Further, the rib 12*e* is also settled within the cleaning frame body 11*d* in its longitudinal direction and, therefore, there is no damage received by the rib 12*e* by the impact during transportation of the process cartridge and attachment/detachment handling operation and the like.

Figure 17:
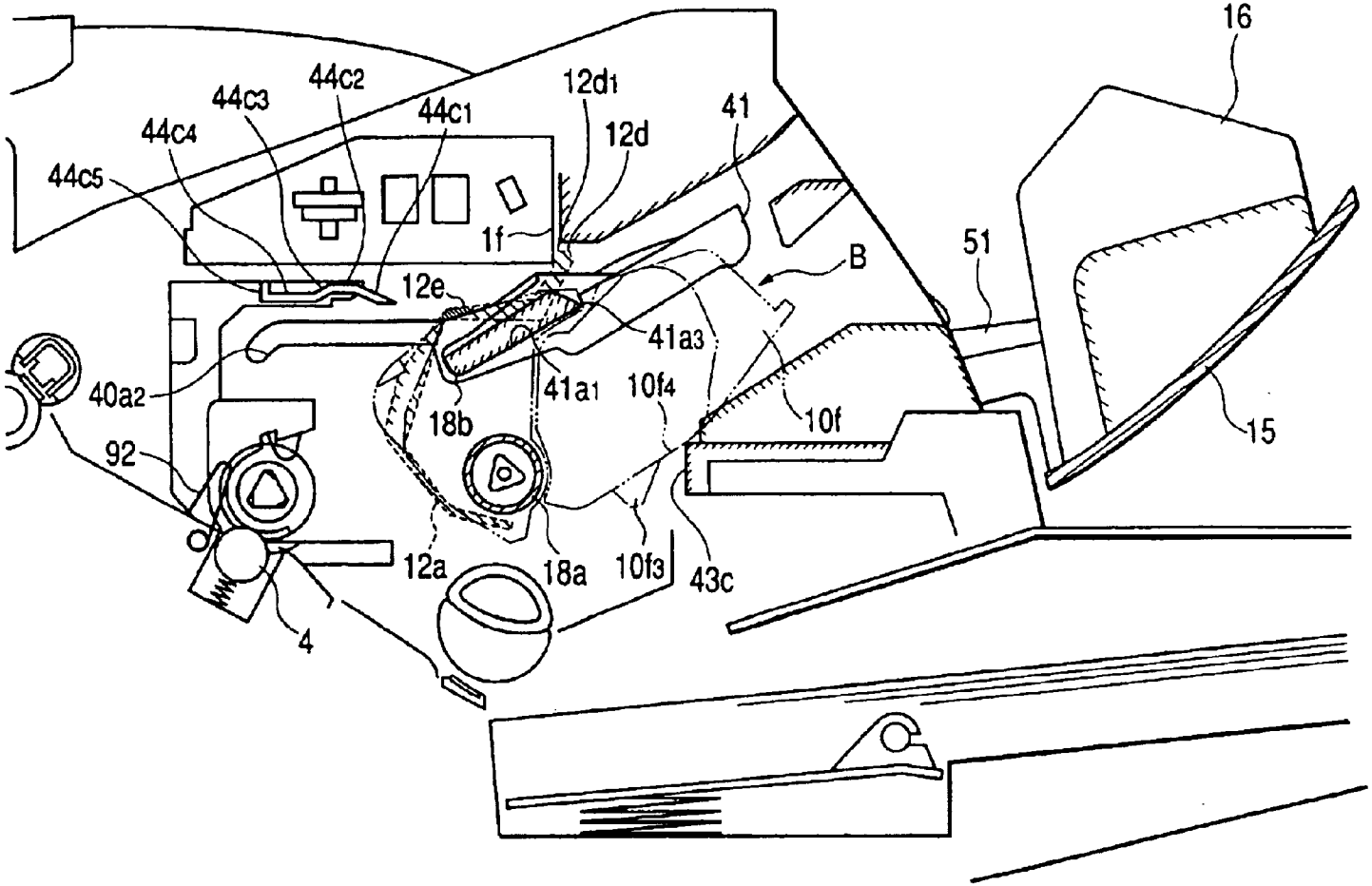
FIG. 17 is an explanatory view of the process cartridge inserting operation into the process cartridge attachment/detachment mechanism to illustrate a moving state of the process cartridge looking toward the right inner side plate from the left side in the image forming apparatus.
Figure 18:
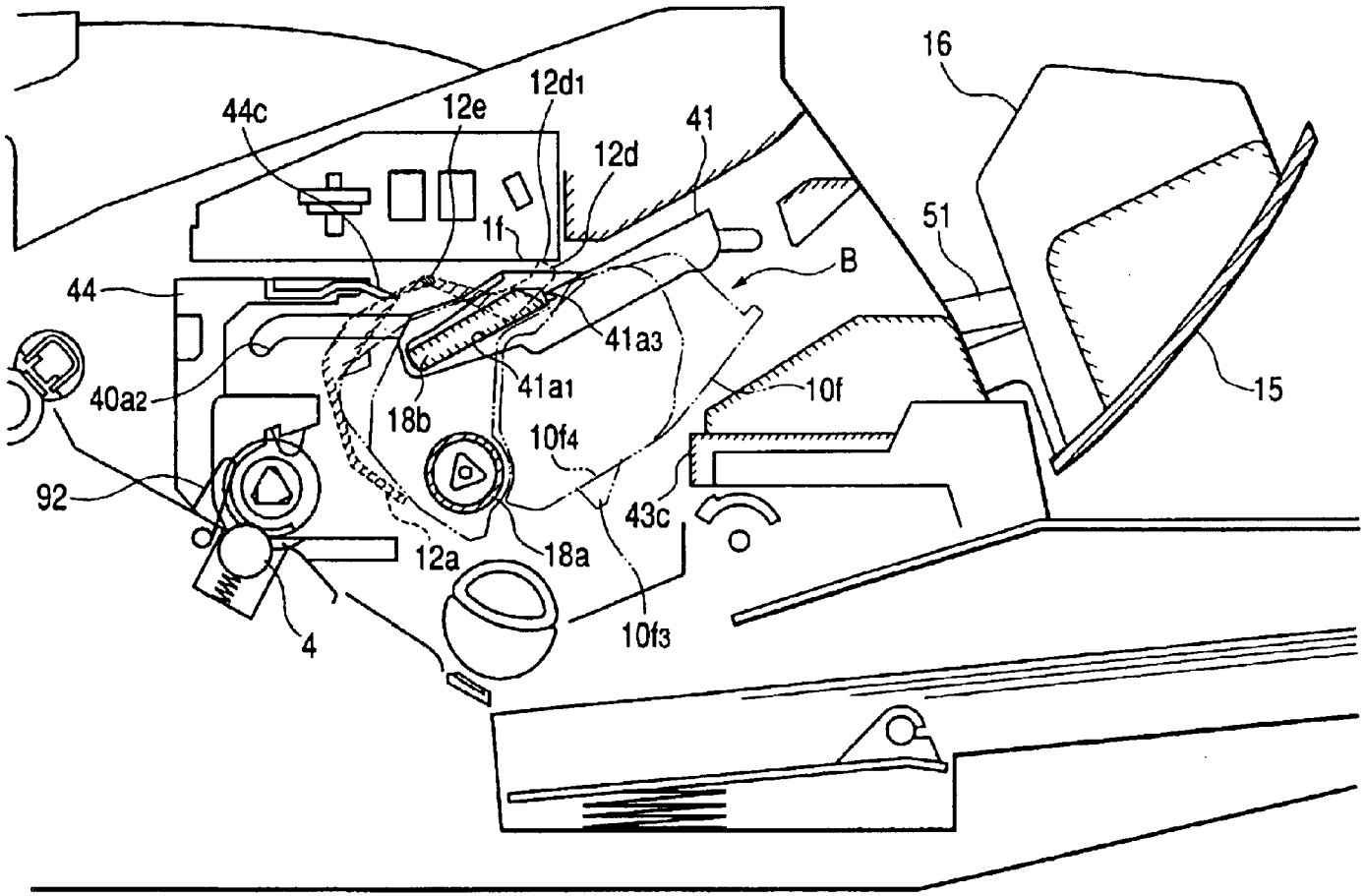
FIG. 18 is an explanatory view of the process cartridge inserting operation into the process cartridge attachment/detachment mechanism to illustrate a moving state of the process cartridge looking toward the right inner side plate from the left side in the image forming apparatus.

When the process cartridge B is moved by linking with opening and closing operation of the opening/closing cover 15, as shown in FIG. 17, the cam portion 12*d* (a first protrusion) of the drum shutter 12 is brought into contact with an optical plate (a first abutting portion) which mounts an optical system 1 inside the image forming apparatus main body and is supported between the left and right inner side plates. The movement of the process cartridge B causes the cam portion 12*d* to rotate clockwise against the spring pressure of a shutter spring and begin to expose the transfer opening 9*a* and the exposure opening 9*b*

Then, the rib 12*e* provided in the connecting or linkage portion (supporting portion) 12*c* moves to a position separated from the upper surface of the cleaning frame body 11*d*, and the abutting surface with the shutter guide 44*c* is exposed. When the process cartridge moves to the inner part, the cam portion 12*d* of the drum shutter 12, after being brought into contact with the angle portion of the optical plate 1*f*, moves while allowing the apex portion 12*d*1 of the top end of the cam portion 12*d* to abut against the bottom surface of the optical plate 1*f*. When the process cartridge B moves further than this to the inner part, the rib 12*e* and the shutter guide 44*c* of the fixed guide 44 abut against each other, and the drum shutter 12 is further opened. By this way, the abutting surface apex portion 12*d*1 of the cam portion 12*d* separates from the bottom surface of the optical plate 1*f*(see FIG. 19).

The shutter guide 44*c* is arranged to overlap on the cleaning frame body 11*d* and has a width to receive the rib 12*e*. The shutter guide 44*c*, as shown in FIG. 17, is constituted in order from the upstream side in the inserting direction of the process cartridge B by the first inclined plane 44*c*1 with the downstream side in the inserting direction inclined upward, the apex portion 44*c*2, the second inclined plate 44*c*3 inclined downward to the downstream side in the inserting direction, a horizontal plane 44*c*4 and a vertical portion 44*c*5 which is the lowest downstream side in the inserting direction of the process cartridge.

Figure 19:
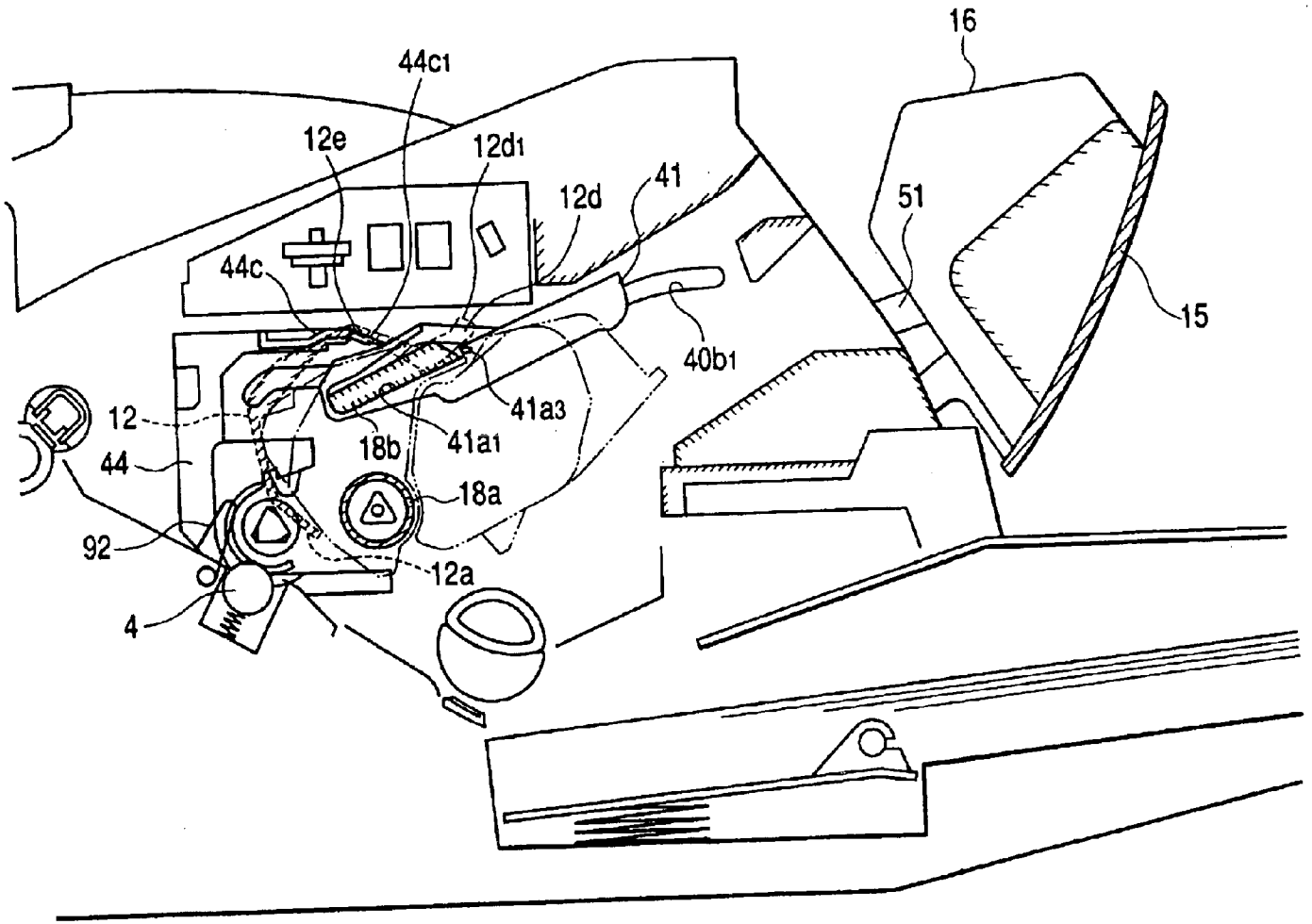
FIG. 19 is an explanatory view of the process cartridge inserting operation into the process cartridge attachment/detachment mechanism to illustrate a moving state of the process cartridge looking toward the right inner side plate from the left side in the image forming apparatus.
Figure 20:
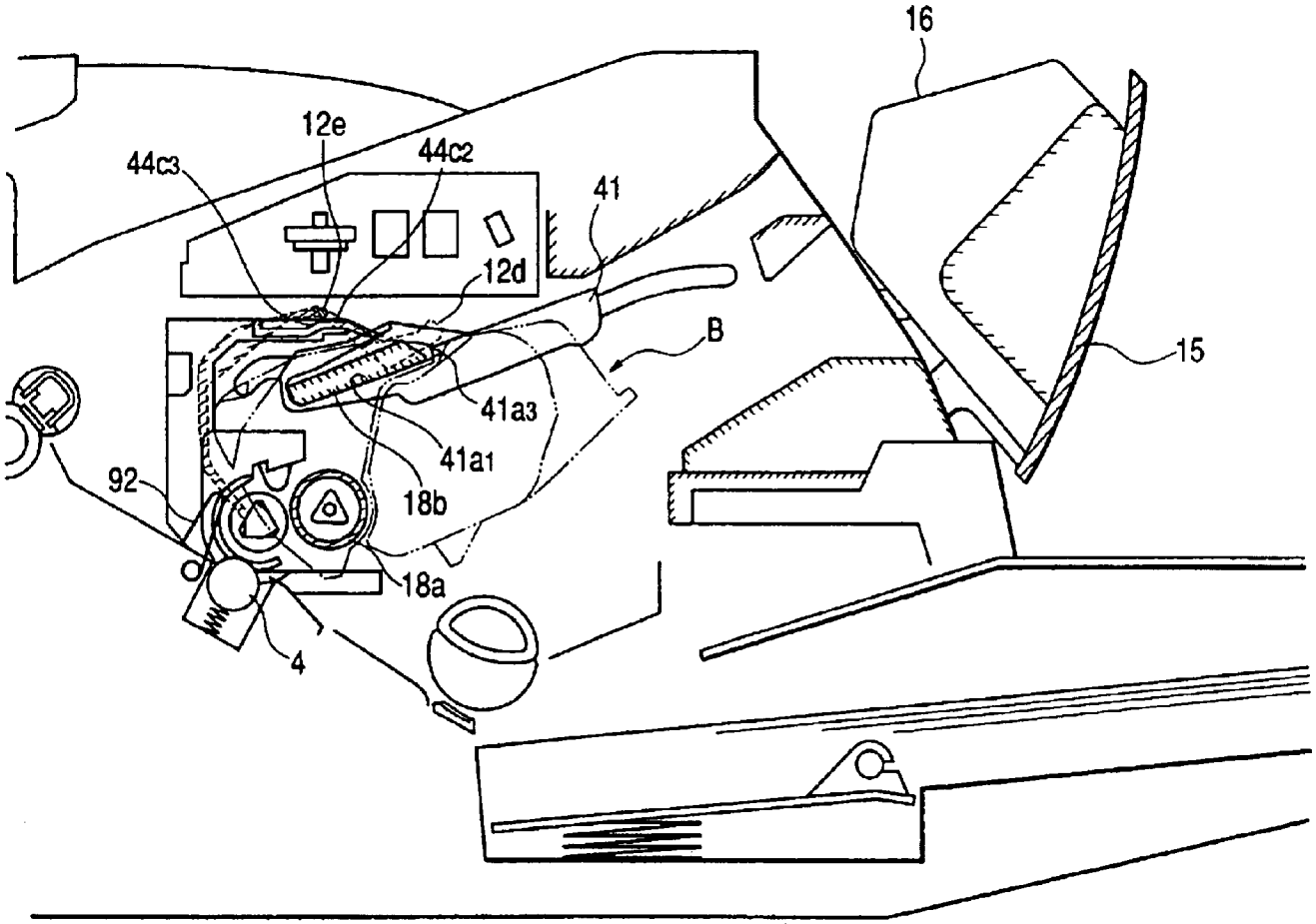
FIG. 20 is an explanatory view of the process cartridge inserting operation into the process cartridge attachment/detachment mechanism to illustrate a moving state of the process cartridge looking toward the right inner side plate from the left side in the image forming apparatus.
Figure 21:
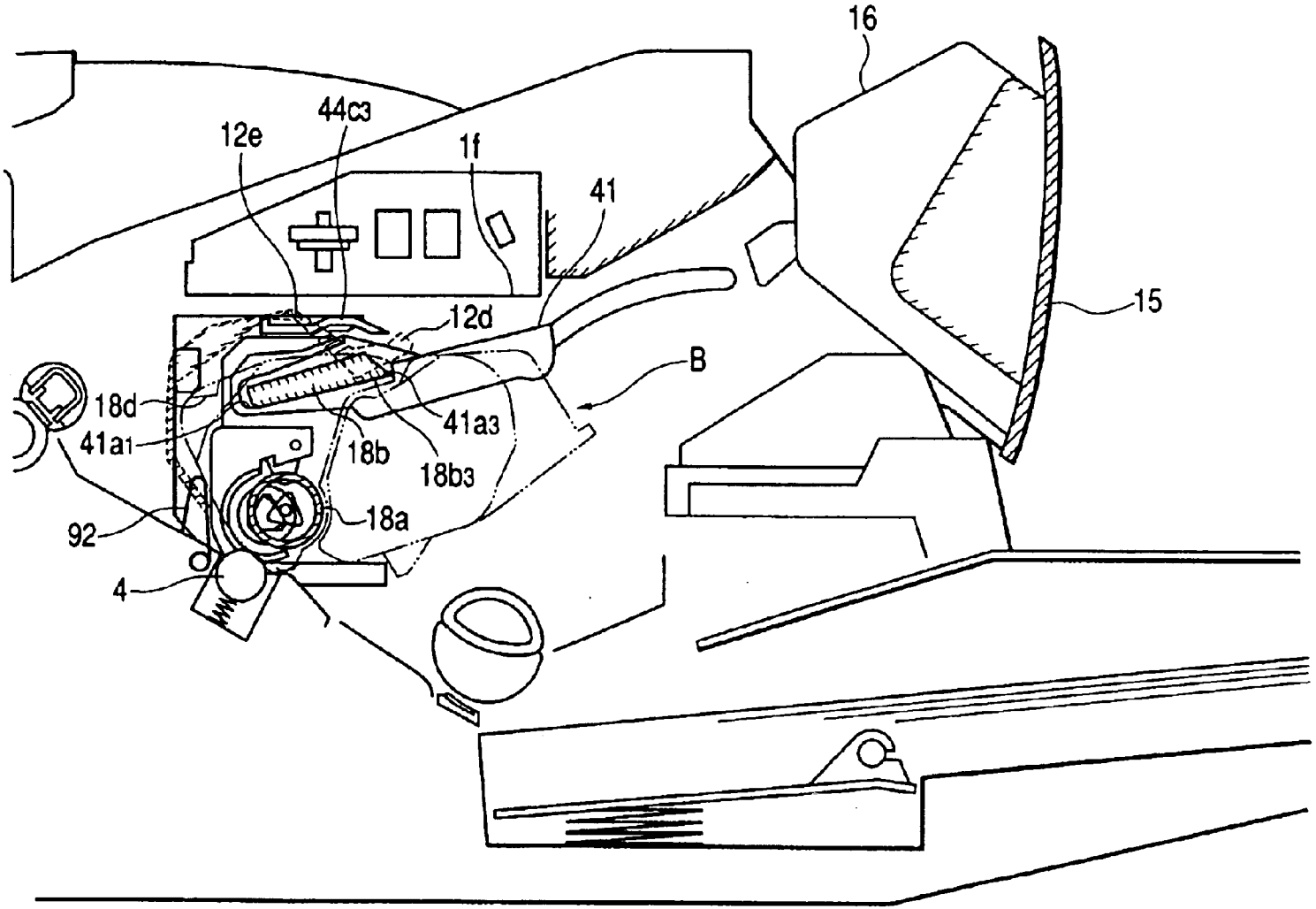
FIG. 21 is an explanatory view of the process cartridge inserting operation into the process cartridge attachment/detachment mechanism to illustrate a moving state of the process cartridge looking toward the right inner side plate from the left side in the image forming apparatus.

As described above, the shutter guide 44*c* puts the cam portion 12*d* to the optical plate 1*f* so as to rotate the drum shutter 12 and receives the rib 12*e* which is separated from the cleaning frame body 11*d*. For this reason, the shutter guide 44*c* is positioned at the downstream side in the process cartridge inserting direction, which avoids a locus at the time when the rib 12*e* is lifted. Further, as shown in FIG. 19, the rib 12*e* is received by the first inclined plane 44*c*1, the upstream side of which descends in the inserting direction so that the rib 12*e* which approaches by the movement of the process cartridge B can be easily scooped up. The rib 12*e* climbs up the first inclined plane 44*c*1 followed by the movement of the process cartridge B, and the drum shutter increases its open angle.

When the opening/closing cover is closed and the process cartridge B is moved into the inner part of the image forming apparatus main body 14, the rib 12*e* of the drum shutter 12 abuts against the apex portion 44*c*2, which is the highest portion of the shutter guide 44*c*, and opens the drum shutter 12 largely. The notch portion 12*f* (see FIG. 4), which is at the top end portion of the left side of the drum shutter 12, avoids an electric contact point 92 provided in the image forming apparatus (see FIG. 20).

After that, the rib 12*e* moves to the second inclined portion 44*c*3 which descended to the downstream side in the inserting direction of the shutter guide 44*c* and inclined and, therefore, the drum shutter 12 closes a little for a while. This second inclined portion 44*c*3 connects the apex portion 44*c*2 which was opened largely to prevent the drum shutter 12 from contacting the electric contact point 92 and the horizontal portion 44*c*4 on which the rib 12*e* lower than the apex portion finally mounts.

Figure 23:
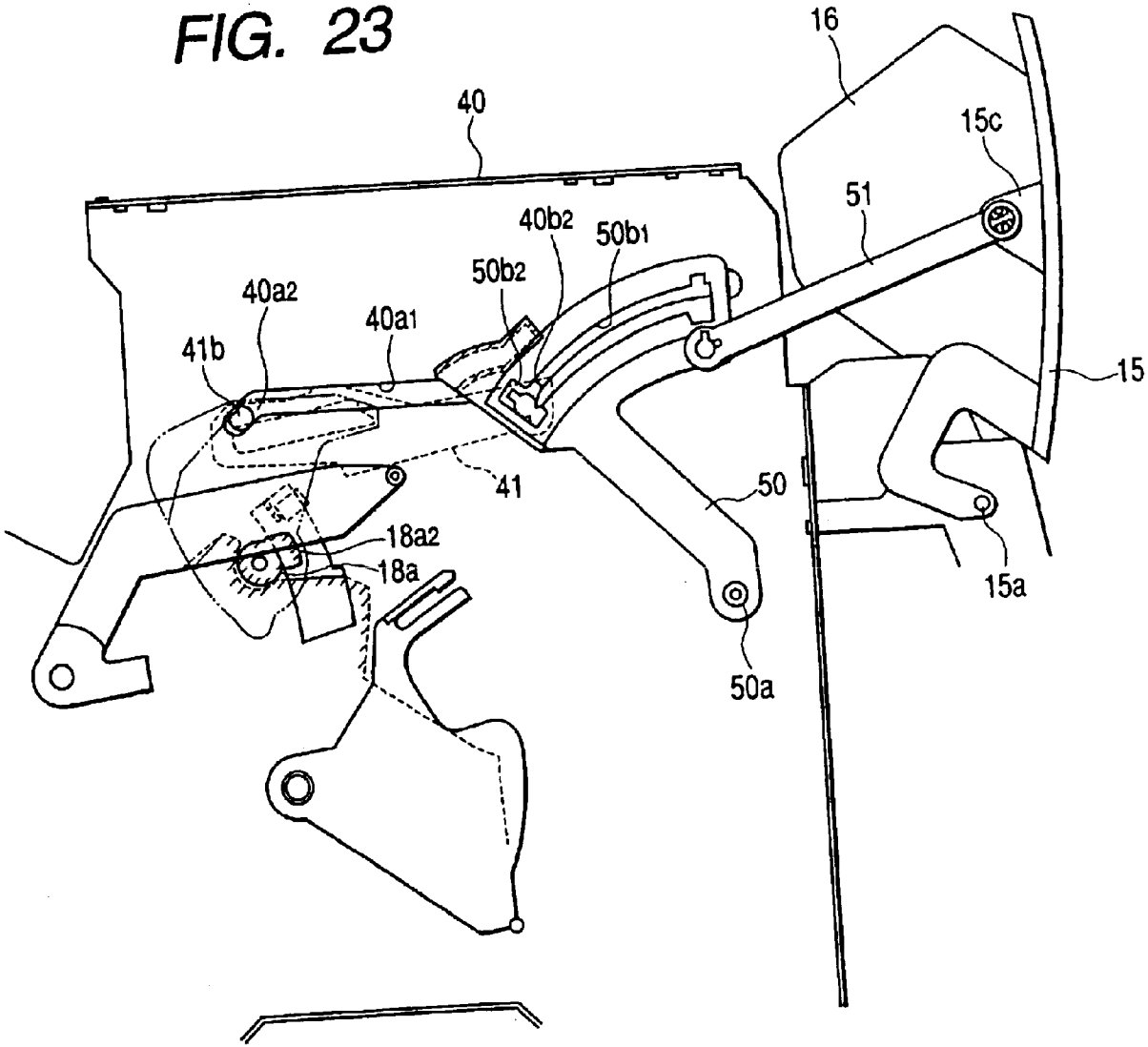
FIG. 23 is an explanatory view of the process cartridge inserting operation into the process cartridge attachment/detachment mechanism to illustrate a moving state of the process cartridge looking at the left inner side plate from the outside in the image forming apparatus.
Figure 24:
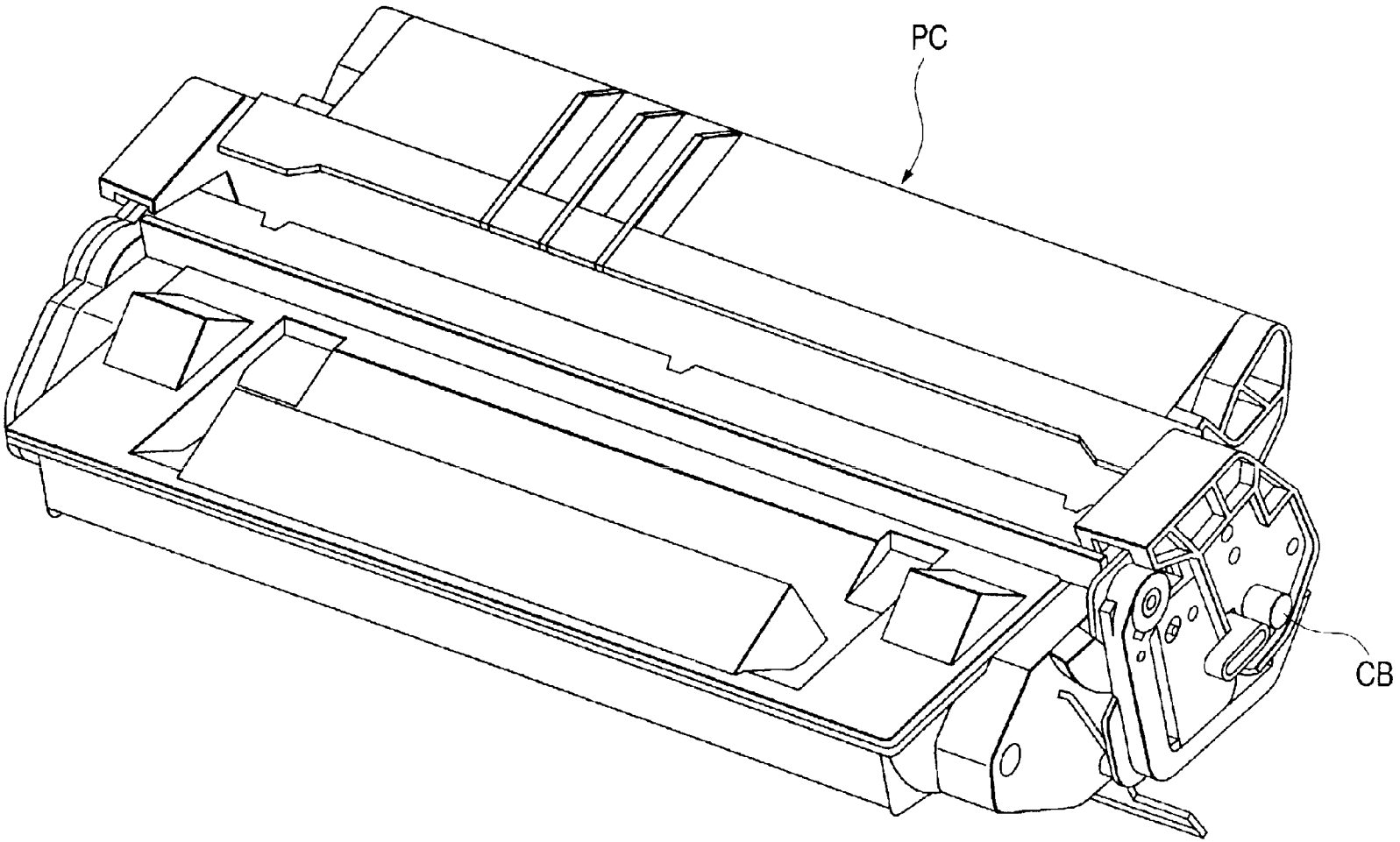
FIG. 24 is a perspective view of the process cartridge attachable to detachable from a cartridge mounting guide of a conventional electrophotographic image forming apparatus main body.
Figure 25:
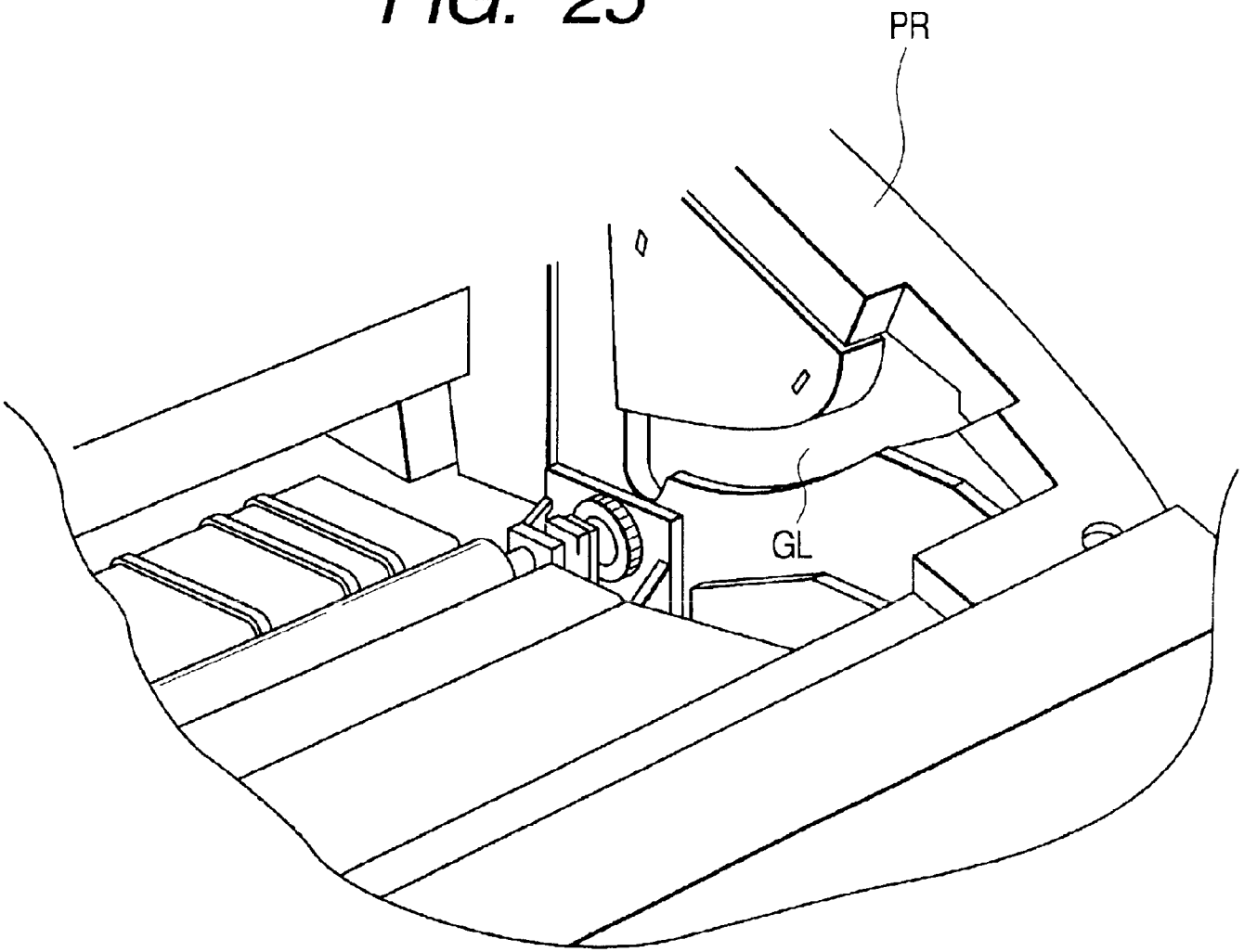
FIG. 25 is an explanatory view of the cartridge mounting guide of the conventional electrophotographic image forming apparatus main body.
Figure 26:
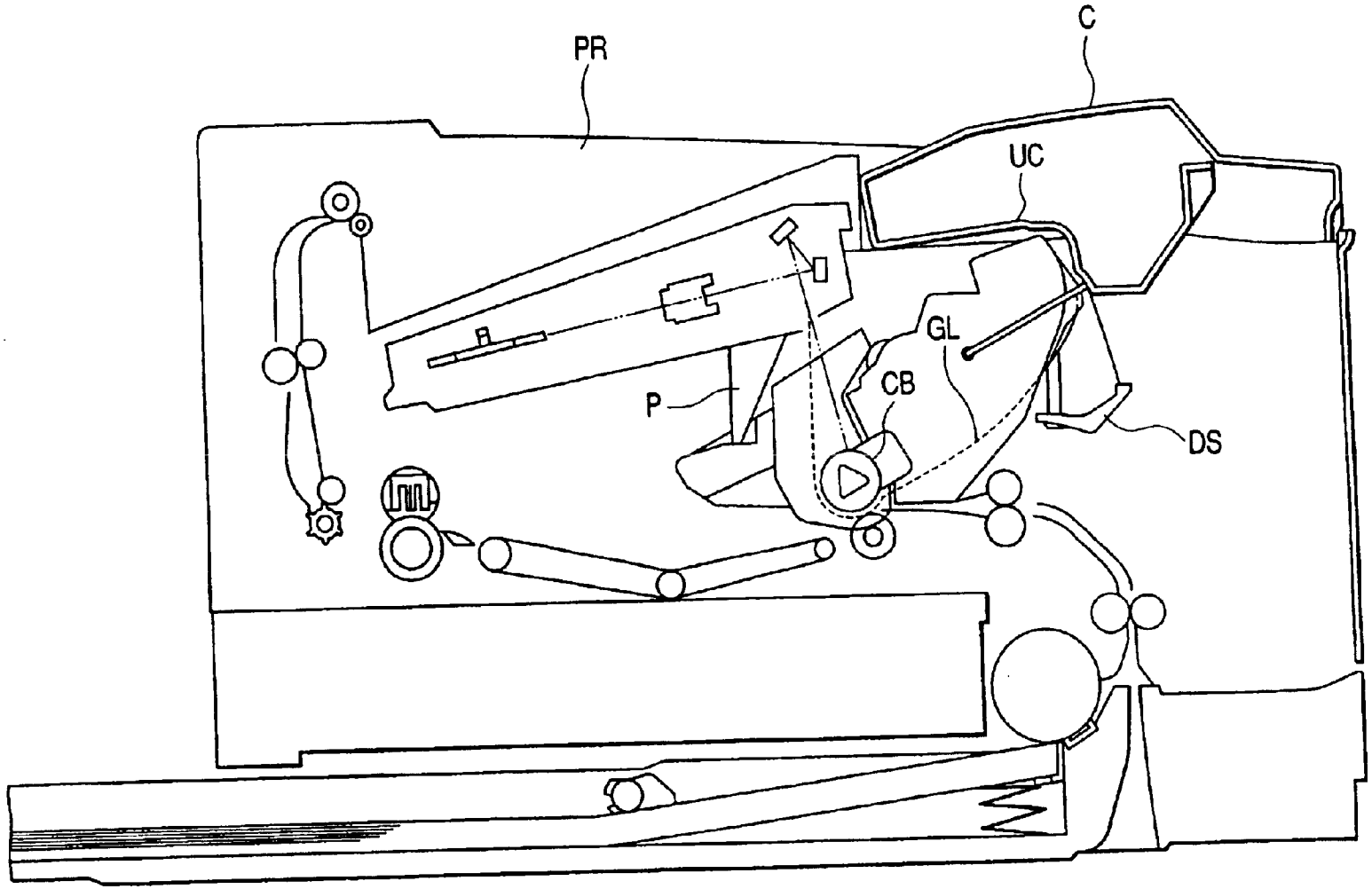
FIG. 26 is an explanatory view of the cartridge mounting guide and the back cover of the conventional electrophotographic image forming apparatus main body.

After that, when the first boss 41*b* of the moving guide 41 moves to the inclined portion 40*a*2 of the first guide rail 40*a*, as shown in FIG. 23, FIG. 7, and FIG. 8, the rib 12*e* of the drum shutter 12 is received by the horizontal portion, though its height is not changed, and the process cartridge B descends to the transfer roller 4 side, and the drum shutter 12 makes its open angle larger.

The movement of the moving guide 41 linked with the rotation of the opening/closing cover 15 stops, and conveyance of the process cartridge followed by it is completed.

Figure 22:
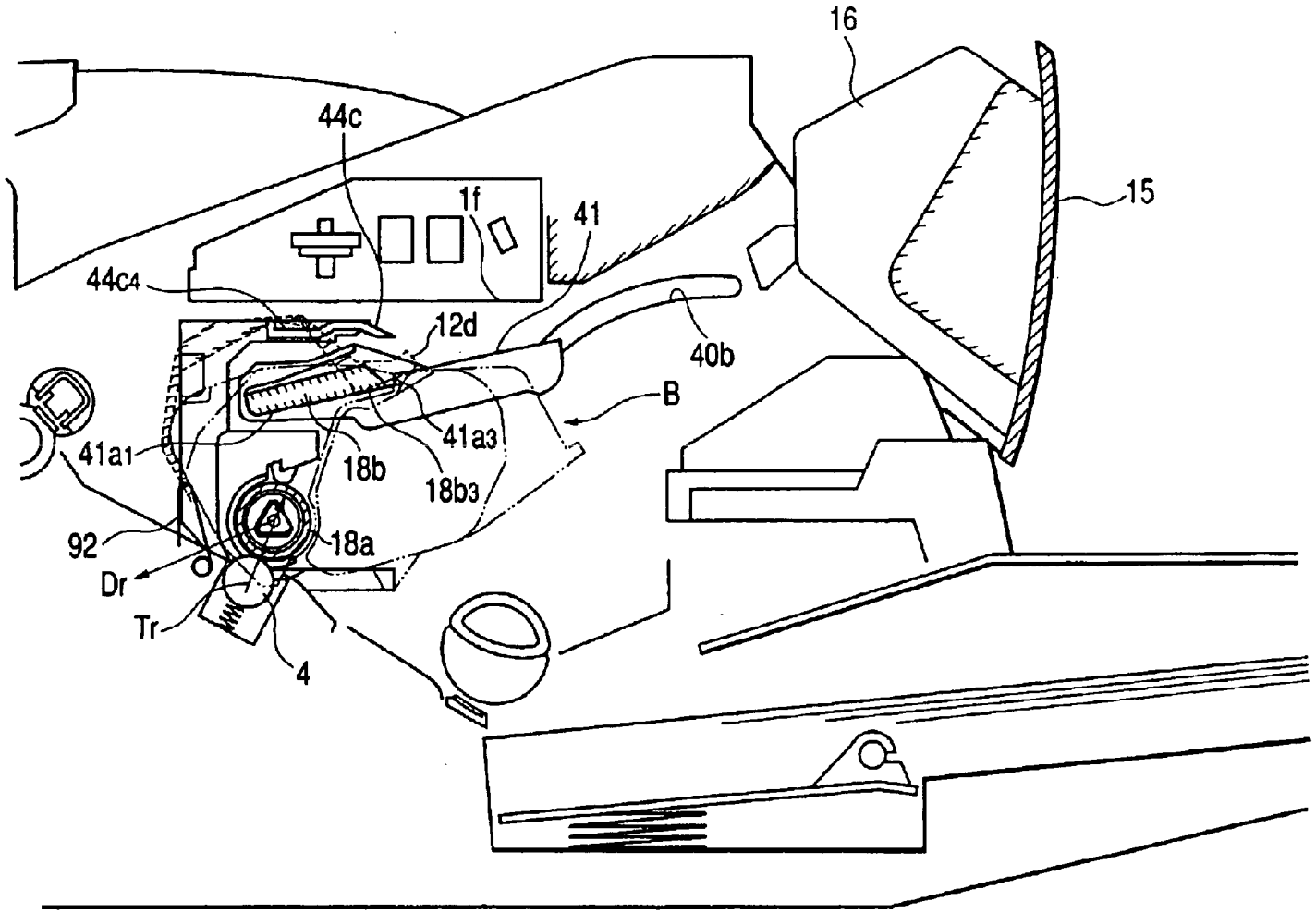
FIG. 22 is an explanatory view of the process cartridge inserting operation into the process cartridge attachment/detachment mechanism to illustrate a moving state of the process cartridge looking toward the right inner side plate from the left side in the image forming apparatus.

Then, as shown in FIG. 22, the rib 12*e* of the drum shutter 12 is supported by the horizontal portion of the shutter guide 44*c* and has a predetermined open angle. The transfer opening and the exposure opening 9*b* are exposed and the process cartridge B is positioned at the apparatus position and is put into a state of forming an image.

When the moving guide 41 completes the movement in the first half of the closing operation of the opening/closing cover 15, the second boss of the moving guide 41 is positioned at the lower end of a straight line portion 40*b*2 of the second guide rail 40*b* of the inner side plate 40 and moves to a circular arc groove hole 50*b*1 of a cam groove 50*b* of a cam plate 50 (see FIG. 23). The circular arc groove hole 50*b*1, as described above, is a circular arc with a rotation axis 50*a* of the cam plate 50 as a center. Further, its radius is equal to the distance from the rotation axis 50*a* to the lower end of the straight line portion 40*b*2 of the second guide rail 40*b*, and its width (inner diameter in the short side direction) is formed slightly wider than the outer diameter of the second boss of the moving guide 41. For this reason, when the opening/closing cover 15 is further closed after the moving guide has been moved, the circular arc groove hole 50*b*1 of the cam groove 50*b* of the cam plate 50 rotates along the second boss of the moving guide 41 and can close the opening/closing cover 15.

(Posture of Process Cartridge Out of Main Body)

When the process cartridge B is placed out of the image forming apparatus, for example, on the desk and the like for jam processing, this action damages the photosensitive drum 7. For this reason, as described above, the drum shutter 12 is provided to shield the photosensitive drum 7 from light and to protect the photosensitive drum 7. However, in the case where the process cartridge B is placed on the desk, when the drum shutter 12 interferes with the desk, it is considered that the drum shutter 12 is deformed, thereby damaging the photosensitive drum 7.

As can be understood by referring to FIG. 2, the lowest portions 100 (a first protruding member, a third protruding member) of the cleaning frame body 11*d* on both sides in the axial direction of the photosensitive drum 7 are positioned in the cleaning frame body 11*d*, which supports the photosensitive drum 7.

Further, as described above, the protrusion 10*f*3 (second and fourth protruding members) which provides a rough guide in the direction to intersect the inserting direction at the time when the process cartridge B is mounted on the image forming apparatus main body 14 is provided on the bottom surface of the process cartridge B. When the process cartridge B is placed on the desk and the like, the drum shutter 12 does not abut against the desk and the like by being supported by this protrusion 10*f*3 and the lowest portion 100.

That is, a line 104 which connects the lowest portion 100 of the cleaning frame body 11*d* and the lowest portion 101 of the protrusion 10*f*3 which was formed by the developing frame body 10*f* and the end portion (holder) member 10*g* of the developing frame body 10*f* is at the lower side lower than the lowest surface 102 positioned at the time when the drum shutter 12 was closed.

Figure 27:
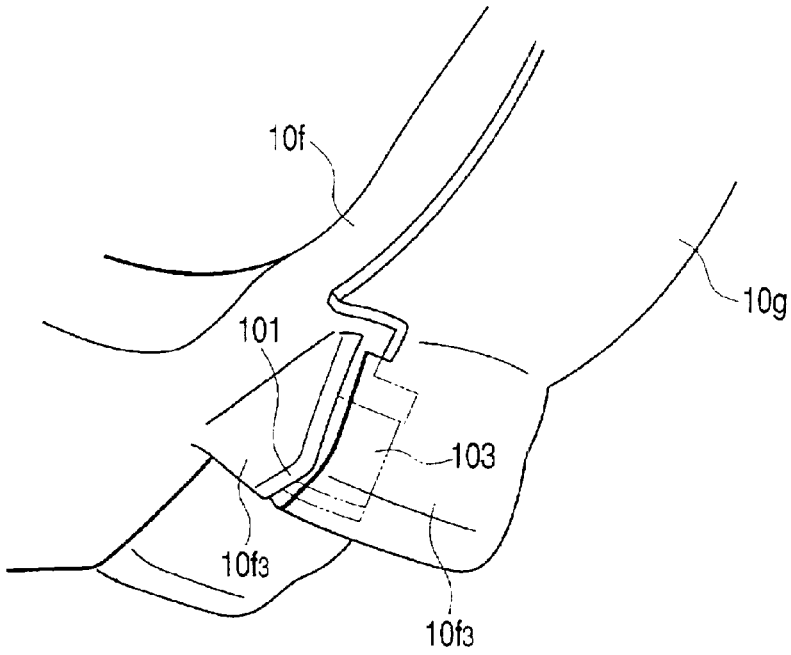
FIG. 27 is an enlarged perspective view of a process cartridge bottom surface protrusion.

As shown in an enlarged view in FIG. 27, one portion 103 of the developing frame body 10*f* is arranged at the inner side on the outer shape of the end portion member 10*g*, and the protrusion 10*f*3 becomes a reinforcement when the process cartridge B is supported.

However, the protrusion 10*f*3 is not formed by both of the developing frame body 10*f* and the end portion member 10*g*, but may be formed by the end portion member 10*g* only or by the developing frame body 10*f* only. Further, when it is a process cartridge where there exist no residual toners, the lowest portion 100 of the cleaning frame body 11*d* may be a frame body to support the photosensitive drum 7. Thus, in the present embodiment, operability at the time when the process cartridge B is mounted on the apparatus main body can be improved. Further, when the process cartridge is placed out of the apparatus main body at the time of jam processing, the posture thereof can be stabilized and the damage to the image bearing body and the like can be prevented.

While the process cartridge shown in the above described embodiment illustrated the case of forming a monochromatic image, the process cartridge according to the present invention provides a plurality of developing means and can be suitably adapted to the cartridge which forms an image having a plurality of colors (for example, a two-tone color image, a three-tone color image or full color and the like).

With respect to the electrophotographic photosensitive body, it is not limited to the photosensitive drum and, for example, includes the following. First, as for the photosensitive body, a photoconductor is used. As for the photoconductor, for example, amorphous silicon, amorphous selenium, zinc oxide, titanium oxide, organic photoconductor (OPC) and the like are included. As for a shape to mount the photosensitive body, for example, a cylindrical or belt shape is used. For example, with respect to a drum type photosensitive body, the photoconductor is deposited or painted on the cylinder of aluminum alloy and the like.

As for a developing method, it is possible to use various kinds of known developing methods such as the binary magnetic brush developing method, the cascade developing method, the touchdown method, the cloud method and the like.

As for charging means, while the above described embodiment used a so-called contact charging method, needless to mention, it may be all right to use such a constitution as the other constitution, wherein a metallic shield such as aluminum is placed around a three sided periphery of a tungsten wire used as before and positive or negative ion generated by applying high voltage on the tungsten wire are moved on the surface of the photosensitive drum, thereby uniformly charging the surface of the drum.

Note that, as for the charging means, other than the roller type, charging means such as a blade (charged blade), a pad type, a block type, a rod type, a wire type may be acceptable.

As for the method of cleaning the residual toners on the photosensitive drum, cleaning means may be constituted by using a blade, a fur brush, a magnetic brush and the like.

What is meant by the above described process cartridge, for example, is a process cartridge comprising the electrophotographic photosensitive body and at least one of the process means. Accordingly, the modes of the process cartridge include, other than those described in the above described embodiment, for example, those integrating the electrophotographic photosensitive body and the charging means into a cartridge and made attachable and detachable to and from the apparatus main body, those integrating the electrophotographic photosensitive body and the developing means into a cartridge and made attachable to and detachable from the apparatus main body, those integrating the electrophotographic photosensitive body and the cleaning means into a cartridge and made attachable to and detachable from the apparatus main body and, furthermore, those combining and integrating the electrophotographic photosensitive body and not less than two of the process means into a cartridge and made attachable to and detachable from the apparatus.

That is, what is meant by the above described process cartridge is a process cartridge which integrates the charging means, the developing means or the cleaning means and the electrophotographic photosensitive body into a cartridge and makes this cartridge attachable to and detachable from the image forming apparatus main body. Further, it means a cartridge which integrates the charging means, the developing means, at least one of the cleaning means and the electrophotographic photosensitive body into a cartridge and makes it attachable to and detachable from the image forming apparatus main body. Furthermore, it means a cartridge which integrates at least the developing means and the electrophotographic photosensitive body into a cartridge and makes it attachable to and detachable from the image forming apparatus main body. This process cartridge can be made attachable to and detachable from the apparatus main body by the user himself. Therefore, the maintenance of the apparatus main body can be performed by the user himself.

While, in the above described embodiment, a laser beam printer was illustrated as the electrophotography image forming apparatus, the present invention is not limited to this and, for example, it is naturally possible to be used for electrophotography copiers, facsimile machines, or electrophotography image forming apparatuses such as word processors.

(Modified Embodiment 1)

Figure 28:
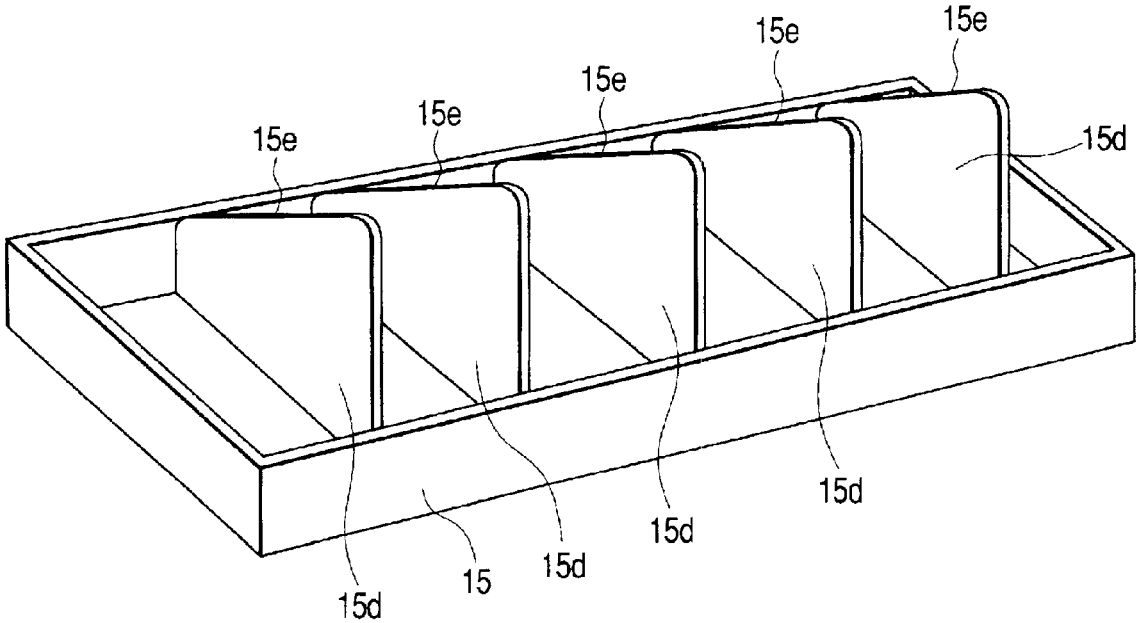
FIG. 28 is a perspective view showing the other embodiment of the inside of the opening/closing cover.

As shown in FIG. 28, the back side of the opening/closing cover 15 can be provided with a plurality of ribs formed integrally. The shape of the end portion 15*e* of the rib 15*d* when the opening/closing cover 15 is fully opened forms a line stretching to the inclined plane 43*b*1 of a front blade.

(Modified Embodiment 2)

Figure 29:
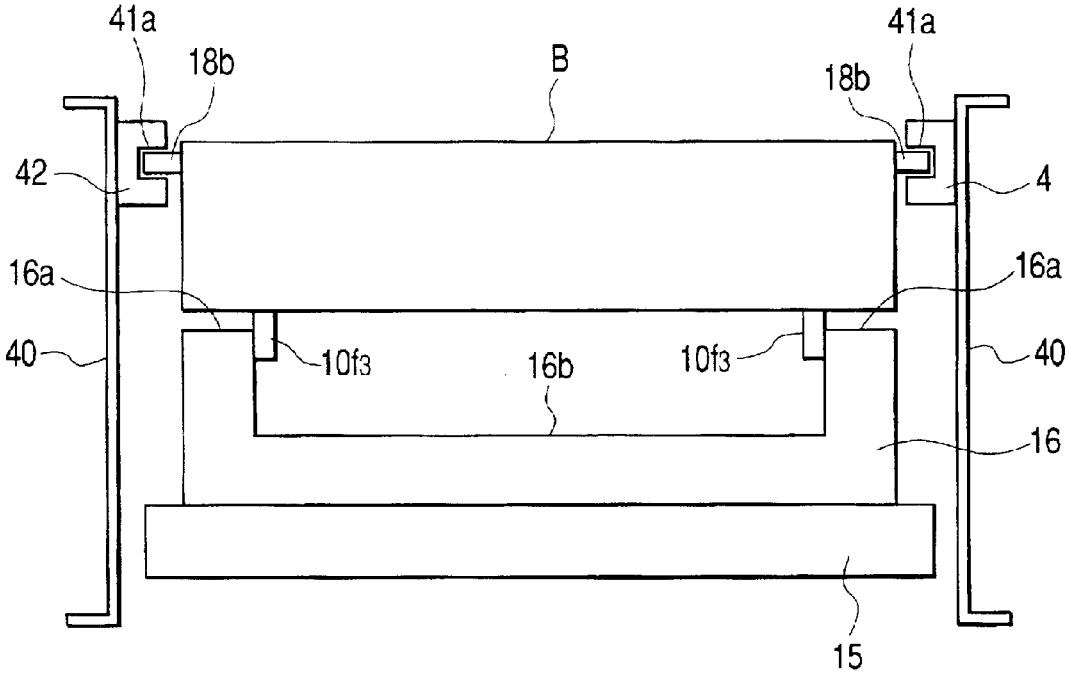
FIG. 29 is an explanatory view showing the positional relation between the opening/closing cover and the process cartridge at the mounting time of the process cartridge.

In the above described embodiment, while the constitution was such that the convex portions 16*a* formed on both ends of the back cover were nipped by protrusions 10*f*3, as shown in FIG. 29, the constitution can be made such that a cavity 16*b* is provided in the center of the back cover 16 and the protrusions 10*f*3 are allowed to fit to this cavity. In this case too, it is similarly possible to regulate the movement in the longitudinal direction of the process cartridge B and easily perform the attachable and detachable operation.

The user can insert his hand into the space created by the cavity 16*b* and support the process cartridge B from the bottom to perform the attachable and detachable operation and, therefore, it is possible to obtain still higher operability.

As described above, according to the present embodiment, when the process cartridge B is placed out of the electrophotographic image forming apparatus main body such as the jam processing by the lowest end portion 100 of the cleaning frame body 11*d* and the protrusion 10*f*3, it is possible to stabilize the posture of the process cartridge B and, at the same time, prevent damage to the photosensitive drum 7 by the drum shutter 12.

Further, the protrusion 10*f*3 includes a guide function to engage with the convex portion 16*a* provided on the opening/closing cover 15 and regulate the direction to intersect the mounting direction at the time when the process cartridge B is mounted on the image forming apparatus main body 14.

Further, the rough guide surface 16*a*1 provided on the convex portion 16*a* abuts against the bottom surface of the toner developing frame body 10*f* of the process cartridge B and the process cartridge B can be guided in the direction to mount on the image forming apparatus 14.

As described above, according to the present invention, mounting performance of the process cartridge for the electrophotography image forming apparatus main body can be improved.

Further, when the process cartridge is taken from the electrophotographic image forming apparatus main body and is placed out of the apparatus main body, it is possible to stabilize the posture of the process cartridge and prevent damage to the electrophotography photosensitive body and the like.

Further, when the process cartridge is taken from the electrophotographic image forming apparatus main body and is placed out of the apparatus main body, it is possible to stabilize the posture of the process cartridge and, at the same time, include a function to regulate the direction to intersect the mounting direction at the time when the protrusion member provided on the frame body to prevent damage to the electrophotographic apparatus and the like mounts the process cartridge on the electrophotographic image forming apparatus main body.

What is claimed is:

1. A process cartridge attachable to and detachable from an electrophotographic image forming apparatus main body including an opening in which said process cartridge is inserted and an opening/closing member movable between a closing position to close the opening and an opening position to open the opening, comprising:

an electrophotographic photosensitive member;

process means for operating on said electrophotographic photosensitive member;

a frame member;

a shutter configured and positioned to protect said electrophotographic photosensitive member, said shutter being movable between a protective position where said electrophotographic photosensitive member is protected and an open position where said shutter is spaced from said protective position and at least a portion of said electrophotographic photosensitive member is unprotected;

a first protruding member protruding downward to said frame member in a mounting direction in which said process cartridge is mounted on the apparatus main body; and a second protruding member protruding downward to said frame member in the mounting direction;

said second protruding member engaging with a regulating guide provided on the opening/closing member to regulate the movement of said process cartridge in an intersecting direction intersecting the mounting direction when said process cartridge is attached in the apparatus main body by passing through the opening.

2. A process cartridge according to claim 1, wherein said frame member comprises a cleaning frame member and wherein said first protruding member is arranged on said cleaning frame member to support said electrophotographic photosensitive member.

3. A process cartridge according to claim 1 or 2, wherein said frame member comprises a developing frame member, wherein said process means comprises a developing member and a developer housing portion, and wherein said second protruding member is arranged on said developing frame member to support said developing member and said developer housing portion.

4. A process cartridge according to claim 1 or 2, wherein said frame member has an end portion member which is positioned at one end side of said process cartridge in an axial line direction said electrophotographic photosensitive member, and wherein said second protruding member is arranged on said end portion member.

5. A process cartridge according to claim 1 or 2, wherein said frame member comprises a developing frame member comprising an end portion member comprising a developing member and a developer housing portion, and wherein said second protruding member is arranged on said developing frame member to support said developing member and said developer housing portion as said end portion member and said process means which are provided on one end side of said process cartridge in an axial line direction of said electrophotographic photosensitive member.

6. A process cartridge attachable to and detachable from an electrophotographic image forming apparatus main body comprising:

an electrophotographic photosensitive member;

process means for operating on said electrophotographic photosensitive member;

a frame member;

a shutter configured and positioned to protect said electrophotographic photosensitive member, said shutter being movable between a protective position where said electrophotographic photosensitive member is protected and an open position where said shutter is spaced from the protective position and at least a portion of said electrophotographic photosensitive member is unprotected;

a first protruding member protruding downward to said frame member in a mounting direction in which said process cartridge is mounted on the apparatus main body and provided on one end side of said process cartridge in the axial line direction of said electrophotographic photosensitive member;

a second protruding member protruding downward to said frame member in the mounting direction;

said second protruding member engaging with a regulating guide provided on the apparatus main body to regulate the movement of said process cartridge in an interesting direction intersecting the mounting direction when said process cartridge is mounted on the apparatus main body; and a third protruding member protruding downward to said frame member and provided on the other end side of said process cartridge in said axial line direction of said electrophotographic photosensitive member.

7. A process cartridge according to claim 6, wherein said frame member comprises a cleaning frame body and wherein said first protruding member and said third protruding member are arranged on said cleaning frame body to support said electrophotographic photosensitive member.

8. A process cartridge according to claim 6 or 7, wherein said frame member comprises a developing frame member, wherein said process means comprises a developing member and a developer housing portion, and wherein said second protruding member is provided on said developing frame member to support said developing member and said developer housing portion.

9. A process cartridge according to claim 6 or 7, wherein said frame member has an end portion member, and wherein said second protruding member is arranged on said end portion member provided on one end side in the axial line direction of said electrophotographic photosensitive member.

10. A process cartridge according to claim 6 or 7, wherein said frame member comprises a developing frame member, wherein said developing frame member comprises said process means, wherein said process means comprises a developing member and a developer housing portion, wherein said developing member and said developing housing portion comprise an end portion member provided on the one end side in the axial line direction of said electrophotographic photosensitive member, and wherein said second protruding member is arranged on said developing frame member to support said developing member and said developer housing portion as the end portion member and said process means.

11. A process cartridge according to claim 6 or 7, wherein said first protruding member and said third protruding member are arranged on both end sides in an axial line direction of said shutter at the protective position.

12. A process cartridge attachable to and detachable from an electrophotographic image forming apparatus main body comprising:

an electrophotographic photosensitive member;

process means for operating on said electrophotographic photosensitive member;

a frame body;

a shutter configured and positioned to protect said electrophotographic photosensitive member, said shutter being movable between a protective position where said electrophotographic photosensitive member is protected and an open position where said shutter is spaced from the protective position and at least a portion of said electrophotographic photosensitive member is unprotected;

a first protruding member protruding downward to said frame member in a mounting direction in which said process cartridge is mounted on the apparatus main body and arranged on one end side of said process cartridge in an axial line direction of said electrophotographic photosensitive member;

a second protruding member protruding downward to said frame member in the mounting direction and arranged on the one end side of said process cartridge in the axial line direction of said electrophotographic photosensitive member;

said second protruding member engaging with a regulating guide provided on the apparatus main body to regulate the movement of said process cartridge in an interesting direction intersecting the mounting direction when said process cartridge is mounted on the apparatus main body;

a third protruding member protruding downward to said frame member and arranged on the other end side of said process cartridge in the axial line direction of said electrophotographic photosensitive member; and a fourth protruding member protruding downward to said frame member in the mounting direction and arranged on the other end side of said process cartridge in the axial line direction of said electrophotographic photosensitive member;

said fourth protruding member engaging with the regulating guide arranged on the apparatus main body to regulate the movement of said process cartridge in the intersecting direction intersecting the mounting direction when said process cartridge is mounted on the apparatus main body.

13. A process cartridge according to claim 12, wherein said frame member comprises a cleaning frame member, and wherein said first protruding member and said third protruding member are arranged on said cleaning frame member to support said electrophotographic photosensitive member.

14. A process cartridge according to claim 12 or 13, wherein said frame member comprises a developing frame member, wherein said process means comprises a developing member and a developer housing portion, and wherein said second protruding member and said fourth protruding member are arranged on said developing frame member to support said developing member and said developer housing portion.

15. A process cartridge according to claim 12 or 13, wherein said frame member has an end portion member provided on the one end side and the other end side of said process cartridge in the axial line direction of said electrophotographic photosensitive member, and wherein said second protruding member and said fourth protruding member are arranged on said end portion member provided on the one end side and the other end side of said process cartridge in the axial line direction of said electrophotographic photosensitive member.

16. A process cartridge according to claim 12 or 13, wherein said frame member comprises a developing frame member, wherein said developing frame member comprises said process means, wherein said process means comprises a developing member and a developer housing portion, wherein said developing member and said developing housing portion comprise an end portion member provided on the one end side and the other end side of said process cartridge in the axial line direction of said electrophotographic photosensitive member, and wherein said second protruding member and said fourth protruding member are arranged on said developing frame member to support said developing member and said developer housing portion.

17. A process cartridge according to claim 12 or 13, wherein said first protruding member and said third protruding member are arranged on both end sides in the axial line direction of said shutter positioned at the protective position.

18. A process cartridge according to claim 1, 6 or 12, wherein an abutting surface is arranged on said frame member, wherein said abutting surface abuts against an inserting guide arranged on the apparatus main body when said process cartridge is mounted on the apparatus main body, the inserting guide guiding said process cartridge in the mounting direction.

19. An electrophotographic image forming apparatus, to which a process cartridge is attachable and from which a process cartridge is detachable, for forming an image on a recording medium, comprising:

an opening for inserting the process cartridge into an image forming apparatus main body;

an opening/closing member arranged on said main body of said image forming apparatus, said opening/closing member being movable between a closing position to close the opening and an opening position to open the opening;

a regulating guide arranged on said opening/closing member to regulate the movement of the process cartridge in an intersecting direction intersecting a mounting direction in which the process cartridge is mounted on said apparatus main body when the process cartridge is mounted on said apparatus main body;

mounting means for detachably and attachably mounting to said apparatus main body the process cartridge having: an electrophotographic photosensitive member; process means for operating on the electrophotographic photosensitive member; a frame member; a shutter configured and positioned to protect the electrophotographic photosensitive member; the shutter being movable between a protective position where the electrophotographic photosensitive member is protected and an open position where the shutter is spaced from the protective position and at least a portion of the electrophotographic photosensitive member is unprotected; a first protruding member protruded downward in the mounting direction; a second protruding member protruding downward to the frame member in the mounting direction and engaging with said regulating guide when the process cartridge is attached in said apparatus main body by passing through the opening;

means for forming an image on the recording medium when the process cartridge is mounted to said apparatus main body; and conveying means for conveying the recording medium.

20. An image forming apparatus according to claim 19, wherein a guiding surface to abut against an abutting surface arranged on the frame member is provided on said regulating guide in order to guide the process cartridge in the mounting direction to be mounted on said apparatus main body.

21. A process cartridge according to claim 6, wherein the electrophotographic photosensitive image forming apparatus main body comprises an opening in which said process cartridge is inserted and an opening/closing member movable between a closing position to close the opening and an opening position to open the opening, wherein the opening/closing member includes a regulating member, and wherein said second protruding member engages the regulating member when said process cartridge is attached in the electrophotographic photosensitive image forming apparatus main body by passing through the opening.

22. A process cartridge according to claim 12, wherein the electrophotographic photosensitive image forming apparatus main body comprises an opening in which said process cartridge is inserted and an opening/closing member movable between a closing position to close the opening and an opening position to open the opening, wherein the opening/closing member includes a regulating member, and wherein at least one of said second protruding member and said fourth protruding member engages the regulating member when said process cartridge is attached in the electrophotographic photosensitive image forming apparatus main body by passing through the opening.

23. A process cartridge according to claim 1, wherein the lowest portion of said first protruding member and the lowest portion of said second protruding member are positioned further downward than said shutter positioned at the protective position.

24. A process cartridge according to claim 6, wherein the lowest portion of said first protruding member, the lowest portion of said second protruding member and the lowest portion of said third protruding member are positioned further downward than said shutter positioned at the protective position.

25. A process cartridge according to claim 12, wherein a lowest portion of said first protruding member, the lowest portion of said second protruding member, the lowest portion of said third protruding member and the lowest portion of said fourth protruding member are positioned further downward than said shutter positioned at the protective position.

26. An electrophotographic image forming apparatus, according to claim 19, wherein the lowest portion of the first protruding portion and the lowest portion of the second protruding portion are positioned further downward than the shutter positioned at the protective position.

* * * * *

UNITED STATES PATENT AND TRADEMARK OFFICE

CERTIFICATE OF CORRECTION

PATENT NO. : 6,895,199 B2
DATED : May 17, 2005
INVENTOR(S) : Minoru Sato et al.

It is certified that error appears in the above-identified patent and that said Letters Patent is hereby corrected as shown below:

Title page,
Item [*] Notice, “by 0 days” should read -- by 150 days --.

Column 4,
Line 58, “to” should read -- to and --.

Column 8,
Line 65, “above described” should read -- above-described --.

Column 10,
Line 15, “above described” should read -- above-described --.
Line 42, “side” should read -- sides --.

Column 11,
Line 55, “night” should read -- right --.

Column 13,
Line 49, “above described” should read -- above-described --.

Column 14,
Line 56, “above described” should read -- above-described --.

Column 15,
Line 65, “9b” should read -- 9b. --.

Column 18,
Lines 12, 34 and 49, “above described” should read -- above-described --.
Line 53, “above” should read -- above- --.

UNITED STATES PATENT AND TRADEMARK OFFICE

CERTIFICATE OF CORRECTION

PATENT NO. : 6,895,199 B2
DATED : May 17, 2005
INVENTOR(S) : Minoru Sato et al.

It is certified that error appears in the above-identified patent and that said Letters Patent is hereby corrected as shown below:

Column 19,
Lines 1 and 18, “above described” should read -- above-described --.
Lines 19 and 22, “electrophotography” should read -- electrophotographic --.
Line 23, “photography” should read -- photographic --.
Line 66, “electrophotography” should read -- electrophotographic --.

Column 20,
Line 5, “electrophotography” should read -- electrophotographic --.

Column 21,
Line 35, “interesting” should read -- intersecting --.

Column 22,
Line 40, “interesting” should read -- intersecting --.

Signed and Sealed this

Eleventh Day of October , 2005

JON W. DUDAS
*Director of the United States Patent and Trademark Office*